US011575212B2

(12) United States Patent
Chan et al.

(10) Patent No.: US 11,575,212 B2
(45) Date of Patent: Feb. 7, 2023

(54) SUBSTRATE INTEGRATED WAVEGUIDE FED ANTENNA

(71) Applicant: City University of Hong Kong, Kowloon (HK)

(72) Inventors: Chi Hou Chan, Kowloon (HK); Manting Wang, Kowloon (HK)

(73) Assignee: City University of Hong Kong, Kowloon (HK)

( * ) Notice: Subject to any disclaimer, the term of this patent is extended or adjusted under 35 U.S.C. 154(b) by 56 days.

(21) Appl. No.: 17/335,249

(22) Filed: Jun. 1, 2021

(65) Prior Publication Data

US 2021/0376479 A1 Dec. 2, 2021

Related U.S. Application Data

(63) Continuation-in-part of application No. 16/889,089, filed on Jun. 1, 2020, now Pat. No. 11,271,322.

(51) Int. Cl.

| | |
|---|---|
| ***H01Q 19/00*** | (2006.01) |
| ***H01Q 21/06*** | (2006.01) |
| ***H01Q 9/04*** | (2006.01) |

(52) U.S. Cl.

CPC ..... *H01Q 19/005* (2013.01); *H01Q 9/0442* (2013.01); *H01Q 21/062* (2013.01); *H01Q 21/065* (2013.01)

(58) Field of Classification Search

CPC ..... H01Q 9/285; H01Q 21/065; H01Q 9/065; H01Q 13/10; H01Q 21/0075; H01Q 21/062; H01Q 5/378; H01Q 13/106; H01Q 19/108; H01Q 19/005; H01Q 5/392; H01Q 21/0037; H01Q 9/16

See application file for complete search history.

(56) References Cited

U.S. PATENT DOCUMENTS

| | | | | |
|---|---|---|---|---|
| 6,762,729 | B2 * | 7/2004 | Egashira | H01Q 21/064 343/815 |
| 8,354,972 | B2 * | 1/2013 | Borja | H01Q 1/38 343/815 |
| 2016/0141757 | A1 * | 5/2016 | Lai | H01Q 9/285 343/770 |

OTHER PUBLICATIONS

Substrate-Integrated-Waveguide-Fed Array Antenna Covering 57-71 GHz Band for 5G Applications. Zhu et al. (Year: 2017).*

* cited by examiner

*Primary Examiner* — Vibol Tan

(74) *Attorney, Agent, or Firm* — Renner Kenner Greive Bobak Taylor & Weber

(57) ABSTRACT

A substrate integrated waveguide fed antenna includes an electric dipole arrangement, a parasitic patch arrangement operably coupled with the electric dipole arrangement, and a feed structure. The feed structure includes a substrate integrated waveguide operably coupled with the electric dipole arrangement for exciting the electric dipole arrangement. A slotted conductive surface with a slot is arranged between the electric dipole arrangement and the feed structure for operably coupling the feed structure with the electric dipole arrangement.

43 Claims, 31 Drawing Sheets
(2 of 31 Drawing Sheet(s) Filed in Color)

SUBSTRATE INTEGRATED WAVEGUIDE FED ANTENNA

TECHNICAL FIELD

The invention relates to a substrate integrated waveguide fed antenna.

BACKGROUND

Thickness and electrical performances, such as impedance bandwidth, stability of radiation patterns, are common factors that need to be optimized in antenna design.

Plated-through-hole and printed-circuit-board technologies have enabled wideband millimeter-wave antennas and arrays. Q. Zhu, K. B. Ng, C. H. Chan, and K.-M. Luk, "*Substrate-integrated-waveguide fed array antenna covering 57-71 GHz band for 5G applications*," IEEE Trans. Antennas Propag., vol. 65, no. 12, pp. 6298-6306, December 2017 has provided a wideband antenna element and a related antenna array designed based on these technologies. While the wideband antenna element can provide reasonably good performance for some applications, the wideband antenna element is relatively thick. This makes the antenna element not suitable for application in compact devices where space for mounting the antenna element is limited. On the other hand, while the array can provide reasonably good performance for some applications, the array provides a relatively high sidelobe level (~−13 dB). As a result the array is not suitable, or not best adapted, for applications such as collision avoidance radar, wireless point-to-point telecommunications, and 5G communications (where low sidelobe array is essential especially for multiple-input and multiple-output).

SUMMARY OF THE INVENTION

It is an object of the invention to address the above needs, to overcome or substantially ameliorate the above disadvantages, or, more generally, to provide an alternative or improved antenna, in particular a substrate integrated waveguide fed antenna.

In accordance with a first aspect of the invention, there is provided a substrate integrated waveguide fed antenna. The substrate integrated waveguide fed antenna includes an electric dipole, a parasitic patch arrangement operably coupled with the electric dipole, and a feed structure. The feed structure includes a substrate integrated waveguide operably coupled with the electric dipole for exciting the electric dipole. The substrate integrated waveguide fed antenna further includes a slotted conductive surface with a slot arranged between (need not be disposed between) the electric dipole and the feed structure for operably coupling the feed structure with the electric dipole.

In one embodiment of the first aspect, the substrate integrated waveguide fed antenna has a thickness (for each substrate or substrate layer) and a center operation frequency, and the thickness (for each substrate or substrate layer) is less than $0.25\lambda_0$, where $\lambda_0$ is a free-space wavelength at the center operation frequency. In one embodiment, the thickness (for each substrate or substrate layer) is less than $0.1\lambda_0$. In yet another embodiment, the thickness (for each substrate or substrate layer) is about $0.07\lambda_0$, e.g., about $0.071\lambda_0$. The substrate integrated waveguide fed antenna may have two or more substrates or substrate layers.

In one embodiment of the first aspect, the electric dipole is differentially-fed.

In one embodiment of the first aspect, the electric dipole is a printed electric dipole.

In one embodiment of the first aspect, the electric dipole includes a pair of elongated dipole arms arranged on a plane spaced apart from and generally parallel to the slotted conductive surface. The elongated dipole arms are spaced apart from each other and are aligned along an axis. In one example, the electric dipole consists essentially of the pair of elongated dipole arms. The elongated dipole arms are in the form of conductive patches.

In one embodiment of the first aspect, in plan view, the axis along which the dipole arms align extends substantially perpendicularly to the slot and crosses the slot.

In one embodiment of the first aspect, the substrate integrated waveguide fed antenna further includes a pair of conductive elements each associated with a respective elongated dipole arm. Each of the conductive elements extends generally perpendicular to the plane and to the slotted conductive surface. The conductive elements are arranged on opposite sides of the slot in plan view. The conductive elements may be in the form of vias, via holes, pins, or like conductive means.

In one embodiment of the first aspect, the parasitic patch arrangement includes a plurality of conductive patches arranged on the plane on which the elongated dipole arms are arranged.

In one embodiment of the first aspect, the plurality of conductive patches are arranged around the electric dipole.

In one embodiment of the first aspect, the plurality of conductive patches includes four conductive patches that are spaced apart from each other. In one example, the comprised consists essentially of the four conductive patches.

In one embodiment of the first aspect, the conductive patches are arranged such that each elongated dipole arm is at least partly disposed between two respective conductive patches.

In one embodiment of the first aspect, the slot is a dumbbell-shaped slot having an elongated central slot portion and enlarged slot portions at two ends of the elongated central slot portion.

In one embodiment of the first aspect, the substrate integrated waveguide fed antenna further includes a substrate. The electric dipole and the parasitic patch arrangement are arranged on an outer surface of the substrate.

In one embodiment of the first aspect, the substrate integrated waveguide fed antenna further includes a conductive surface arranged on the outer surface of the substrate. The conductive surface surrounds the electric dipole and the parasitic patch arrangement. Such conductive surface, the electric dipole, and the parasitic patch arrangement may be arranged as the same layer, e.g., formed by etching.

In one embodiment of the first aspect, the substrate is a first substrate layer. The substrate integrated waveguide comprises a second substrate layer, a plurality of via holes formed in the second substrate layer, and a conductive surface on the second substrate layer. The slotted conductive surface is disposed between the first substrate layer and the second substrate layer. The substrate integrated waveguide may further include one or more impedance matching elements, which may be in the form of vias, via holes, pins, or like conductive means.

In one embodiment of the first aspect, the conductive surface on the second substrate layer includes a slot that is generally aligned with the slot of the slotted conductive surface.

In one embodiment of the first aspect, the slot of the conductive surface on the second substrate layer is larger than the slot of the slotted conductive surface.

In one embodiment of the first aspect, the first substrate layer and the second substrate layer has generally the same dielectric constant and/or generally the same thickness.

In one embodiment of the first aspect, the substrate integrated waveguide fed antenna is a linearly-polarized antenna operable to provide a linearly-polarized radiation pattern.

In one embodiment of the first aspect, the substrate integrated waveguide fed antenna is adapted for operation in the range of 22.3 GHz to 32.1 GHz. In one example, the substrate integrated waveguide fed antenna may operate in other frequencies as well. In one example, the substrate integrated waveguide fed antenna is adapted for 5G applications.

In accordance with a second aspect of the invention, there is provided a substrate integrated waveguide fed antenna that includes: a plurality of electric dipoles arranged in an array, a plurality of parasitic patch arrangements each operably coupled with a respective one of the electric dipoles, and a feed structure. The feed structure includes a substrate integrated waveguide operably coupled with the electric dipoles for exciting the electric dipoles. The substrate integrated waveguide fed antenna also includes a slotted conductive surface with a plurality of slots each associated with a respective electric dipole. Each of the slots is arranged between the respective electric dipole and the feed structure for operably coupling the feed structure with the respective electric dipole.

In one embodiment of the second aspect, the array is a regular array. For example, the array is an N×M array, where N and M can be any positive integer. The electric dipoles in the array may be equally spaced apart.

In one embodiment of the second aspect, each of the electric dipole includes a pair of elongated dipole arms arranged on a plane spaced apart from and generally parallel to the slotted conductive surface. Also, for each respective one of the electric dipole, the elongated dipole arms are spaced apart from each other and are aligned along an axis. In one example, each of the electric dipole consists essentially of a pair of elongated dipole arms.

In one embodiment of the second aspect, in plan view, each respective axis extends substantially perpendicularly to each respective slot and crosses the respective slot.

In one embodiment of the second aspect, the substrate integrated waveguide fed antenna array further includes, for each respective one of the electric dipole, a pair of conductive elements each associated with a respective elongated dipole arm. Each of the conductive elements extend generally perpendicular to the plane and to the slotted conductive surface, and are arranged on opposite sides of the respective slot in plan view. The conductive elements may be in the form of vias, via holes, pins, or like conductive means.

In one embodiment of the second aspect, the parasitic patch arrangement includes a plurality of conductive patch assemblies arranged on the plane. Each of the respective conductive patch assembly is arranged around a respective one of the electric dipole.

In one embodiment of the second aspect, each of the respective conductive patch assembly includes four conductive patches that are spaced apart from each other. In one example, each conductive patch assembly comprised essentially of the four conductive patches.

In one embodiment of the second aspect, the conductive patches are arranged such that each elongated dipole arm is at least partly disposed between two respective conductive patches in the respective conductive patch assembly.

In one embodiment of the second aspect, each of the slots in the slotted conductive surface is a dumbbell-shaped slot having an elongated central slot portion and enlarged slot portions at two ends of the elongated central slot portion. The slots are arranged in an array corresponding to the electric dipole array.

In one embodiment of the second aspect, the substrate integrated waveguide fed antenna array further includes a substrate. The electric dipoles and the parasitic patch arrangements are arranged on an outer surface of the substrate.

In one embodiment of the second aspect, the substrate integrated waveguide fed antenna array further includes a conductive surface arranged on the outer surface of the substrate. The conductive surface surrounds the electric dipoles and the parasitic patch arrangements. Such conductive surface, the electric dipoles, and the parasitic patch arrangements may be arranged as the same layer, e.g., formed by etching.

In one embodiment of the second aspect, the substrate integrated waveguide comprises a power divider portion and a coupler portion.

In one embodiment of the second aspect, the substrate integrated waveguide includes: a first substrate layer with a vias network formed by a plurality of vias, arranged to provide the power divider portion for dividing power received from an external source (e.g., waveguide) for providing to the electric dipoles. The substrate integrated waveguide further includes a second substrate layer with a vias network formed by a plurality of vias, arranged to provide the coupler portion. A further slotted conductive surface with a plurality of slots is arranged between the first and second substrate layers for electrically coupling the first and second substrate layers. The second substrate layer is arranged between the first substrate layer and the slotted conductive surface.

In one embodiment of the second aspect, the power divider portion includes a plurality of power divider assemblies. Each of the power divider assemblies includes an input port and a plurality of output ports.

In one embodiment of the second aspect, each of the power divider assemblies is arranged to divide a power input received at the input port unequally among the plurality of output ports.

In one embodiment of the second aspect, at least some of the vias in the power divider portion are arranged to form a phase control arrangement arranged to substantially equalize a phase of the signals output by the output ports.

In one embodiment of the second aspect, the vias in the coupler portion form a plurality of multi-way couplers. Each of the multi-way coupler is arranged to operably couple one of the slots in the further slotted conductive surface to a respective plurality of slots in the slotted conductive surface.

In one embodiment of the second aspect, the substrate integrated waveguide further includes an input transition portion. For example, the substrate integrated waveguide may further include a third substrate layer with a vias network formed by a plurality of vias, arranged to provide the input transition portion.

In one embodiment of the second aspect, the substrate layers (along with the slotted/further slotted conductive layers) are fastened together using fasteners. The fasters may be screws, nuts, bolts, e.g., made of plastic.

In one embodiment of the second aspect, the substrate integrated waveguide can include additional substrate layers and/or conductive surfaces.

In one embodiment of the second aspect, the substrate integrated waveguide fed antenna array is adapted for 5G applications.

In accordance with a third aspect of the invention, there is provided a communication device including the substrate integrated waveguide fed antenna of the first aspect. The communication device may be any information handling system or signal/data processing system, such as a base station, a computer, a mobile phone, a tablet computer, a smart watch, an IoT device, etc. The communication device may be particularly adapted for 5G applications. The communication device may be used for other applications too, for example, 3G, 4G, WiMAX, etc.

In accordance with a fourth aspect of the invention, there is provided a communication device including the substrate integrated waveguide fed antenna array of the second aspect. The communication device may be any information handling system or signal/data processing system, such as a base station, a computer, a mobile phone, a tablet computer, a smart watch, an IoT device, etc. The communication device may be particularly adapted for 5G applications. The communication device may be used for other applications too, for example, 3G, 4G, WiMAX, etc.

In accordance with a fifth aspect of the invention, there is provided a substrate integrated waveguide fed antenna. The substrate integrated waveguide fed antenna includes an electric dipole arrangement; a parasitic patch arrangement operably coupled with the electric dipole arrangement; a feed structure including a substrate integrated waveguide operably coupled with the electric dipole arrangement for exciting the electric dipole arrangement; and a slotted conductive surface with a slot arranged between the (need not be disposed between) electric dipole arrangement and the feed structure for operably coupling the feed structure with the electric dipole arrangement.

In one embodiment of the fifth aspect, the substrate integrated waveguide fed antenna is the substrate integrated waveguide fed antenna of the first aspect (i.e., the electric dipole arrangement may be the electric dipoles of the first aspect).

In one embodiment of the first aspect, the electric dipole arrangement is a printed electric dipole arrangement.

In one embodiment of the fifth aspect, the electric dipole arrangement comprises a plurality of conductive elements arranged on a plane that is spaced apart from and generally parallel to the slotted conductive surface, and the plurality of conductive elements are spaced apart from each other. The conductive elements may be in the form of conductive patches. The conductive elements are operable to selectively provide, e.g., based on a feed provided by the feed structure, at least, a first electric dipole along a first direction and a second electric dipole along a second direction generally perpendicular to the first direction.

In one embodiment of the fifth aspect, each of the plurality of conductive elements comprises first and second leg portions arranged at an angle to each other. In one example, each of the plurality of conductive elements is comprised of first and second leg portions arranged at an angle to each other.

In one embodiment of the fifth aspect, the angle is any angle between 45 degrees and 135 degrees.

In one embodiment of the fifth aspect, the angle is generally 90 degrees such that each of the plurality of conductive elements is generally L-shaped.

In one embodiment of the fifth aspect, the first leg portions of the plurality of conductive elements are generally parallel to each other. In one example, two first leg portions are arranged generally collinearly with each other along a first axis, and another two first leg portions are arranged generally collinearly with each other along a second axis parallel to the first axis.

In one embodiment of the fifth aspect, the second leg portions of the plurality of conductive elements are generally parallel to each other. In one example, two second leg portions are arranged generally collinearly with each other along a first axis, and another two second leg portions are arranged generally collinearly with each other along a second axis parallel to the first axis.

In one embodiment of the fifth aspect, the plurality of conductive elements are arranged to space apart from each other in such a way that a cross-shaped slot is defined between them. In one embodiment of the fifth aspect, in plan view, the slot is arranged in the cross-shaped slot.

In one embodiment of the fifth aspect, the plurality of conductive elements includes three or more (e.g., four) conductive elements.

In one embodiment of the fifth aspect, the plurality of conductive elements are arranged in a generally symmetric pattern.

In one embodiment of the fifth aspect, the plurality of conductive elements are spaced apart generally equally.

In one embodiment of the fifth aspect, the plurality of conductive elements have generally the same size and shape.

In one embodiment of the fifth aspect, the substrate integrated waveguide fed antenna further comprises a plurality of further conductive elements each associated with a respective conductive element of the electric dipole arrangement. Each of further conductive elements may extend generally perpendicular to the plane and to the slotted conductive surface. The further conductive elements may be in the form of vias, via holes, pins, or like conductive means.

In one embodiment of the fifth aspect, the plurality of conductive elements are generally L-shaped conductive elements each having a corner portion, and, in plan view, the further conductive elements are arranged at or near the corner portions of the generally L-shaped conductive elements. The corner portions of the L-shaped conductive elements may be arranged adjacent each other (e.g., in facing relationship).

In one embodiment of the fifth aspect, the parasitic patch arrangement comprises a plurality of conductive patches arranged on the plane.

In one embodiment of the fifth aspect, the plurality of conductive patches are arranged around the electric dipole arrangement.

In one embodiment of the fifth aspect, the plurality of conductive patches comprises four or more conductive patches that are spaced apart from each other. In one example, the plurality of conductive patches is comprised of or consists essentially of the four conductive patches.

In one embodiment of the fifth aspect, the conductive patches are arranged such that each conductive element is at least partly disposed between two respective conductive patches.

In one embodiment of the fifth aspect, the slot is a cross-shaped slot having first and second slot portions arranged generally perpendicular to each other. The first and second slot portions may have the same length and/or width. The first and second slot portions may have different lengths and/or widths. The first and second slot portions may each be a dumbbell-shaped slot having an elongated central slot portion and enlarged slot portions at two ends of the elongated central slot portion.

In one embodiment of the fifth aspect, the substrate integrated waveguide fed antenna further comprises a substrate. The electric dipole arrangement and the parasitic patch arrangement are arranged on an outer surface of the substrate.

In one embodiment of the fifth aspect, the substrate integrated waveguide fed antenna further comprises a conductive surface arranged on the outer surface of the substrate, the conductive surface generally surrounds the electric dipole arrangement and the parasitic patch arrangement. Such conductive surface, the electric dipole arrangement, and the parasitic patch arrangement may be arranged as the same layer, e.g., formed by etching.

In one embodiment of the fifth aspect, the substrate is a first substrate layer. The substrate integrated waveguide comprises a second substrate layer, a plurality of via holes formed in the second substrate layer, and a conductive surface on the second substrate layer. The slotted conductive surface is disposed between the first substrate layer and the second substrate layer. The substrate integrated waveguide may further include one or more impedance matching elements, which may be in the form of vias, via holes, pins, or like conductive means.

In one embodiment of the fifth aspect, the conductive surface on the second substrate layer comprises a slot that is generally aligned with the slot of the slotted conductive surface.

In one embodiment of the fifth aspect, the slot of the conductive surface on the second substrate layer is larger than the slot of the slotted conductive surface. The slot of the conductive surface on the second substrate layer may have the same shape and/or size as the slot of the slotted conductive surface.

In one embodiment of the fifth aspect, the first substrate layer and the second substrate layer have generally the same dielectric constant and/or generally the same thickness.

In one embodiment of the fifth aspect, the substrate integrated waveguide fed antenna is a dual-polarized antenna.

In one embodiment of the fifth aspect, the substrate integrated waveguide fed antenna is adapted for operation in the range of 22.3 GHz to 32.1 GHz. In one example, the substrate integrated waveguide fed antenna may operate in other frequencies as well. In one example, the substrate integrated waveguide fed antenna is adapted for 5G applications.

In accordance with a sixth aspect of the invention, there is provided a substrate integrated waveguide fed antenna array that includes: a plurality of electric dipole arrangements arranged in an array; a plurality of parasitic patch arrangements each operably coupled with a respective one of the electric dipole arrangement; a feed structure including a substrate integrated waveguide operably coupled with the electric dipole arrangements for exciting the electric dipole arrangements; and a slotted conductive surface with a plurality of slots each associated with a respective electric dipole arrangement, each slot being arranged between the respective electric dipole arrangement and the feed structure for operably coupling the feed structure with the respective electric dipole arrangement.

In one embodiment of the sixth aspect, the substrate integrated waveguide fed antenna array is the substrate integrated waveguide fed antenna array of the second aspect (i.e., the plurality of electric dipole arrangements may be the plurality of electric dipoles of the second aspect).

In one embodiment of the sixth aspect, the electric dipole arrangements are printed electric dipole arrangements.

In one embodiment of the sixth aspect, the array is a regular array. For example, the array is an N×M array, where N and M can be any positive integer. The electric dipoles in the array may be equally spaced apart.

In one embodiment of the sixth aspect, each of the electric dipole arrangements comprises a plurality of conductive elements arranged on a plane that is spaced apart from and generally parallel to the slotted conductive surface; and, for each respective one of the electric dipole arrangement, the plurality of conductive elements are spaced apart from each other. The conductive elements may be in the form of conductive patches. The conductive elements are operable to selectively provide, e.g., based on a feed provided by the feed structure, at least, a first electric dipole along a first direction and a second electric dipole along a second direction generally perpendicular to the first direction.

In one embodiment of the sixth aspect, for each respective one of the electric dipole arrangement, each of the plurality of conductive elements comprises first and second leg portions arranged at an angle to each other. In one example, each of the plurality of conductive elements is comprised of first and second leg portions arranged at an angle to each other.

In one embodiment of the sixth aspect, the angle is any angle between 45 degrees and 135 degrees.

In one embodiment of the sixth aspect, the angle is generally 90 degrees such that each of the plurality of conductive elements is generally L-shaped.

In one embodiment of the sixth aspect, for each respective one of the electric dipole arrangement, the first leg portions of the plurality of conductive elements are generally parallel to each other. In one example, two first leg portions are arranged generally collinearly with each other along a first axis, and another two first leg portions are arranged generally collinearly with each other along a second axis parallel to the first axis.

In one embodiment of the sixth aspect, for each respective one of the electric dipole arrangement, the second leg portions of the plurality of conductive elements are generally parallel to each other. In one example, two second leg portions are arranged generally collinearly with each other along a first axis, and another two second leg portions are arranged generally collinearly with each other along a second axis parallel to the first axis.

In one embodiment of the sixth aspect, the plurality of conductive elements are arranged to space apart from each other in such a way that a cross-shaped slot is defined between them. In one embodiment of the sixth aspect, in plan view, the slot is arranged in the cross-shaped slot.

In one embodiment of the sixth aspect, for each respective one of the electric dipole arrangement, the plurality of conductive elements includes three or more (e.g., four) conductive elements.

In one embodiment of the sixth aspect, for each respective one of the electric dipole arrangement, the plurality of conductive elements are arranged in a generally symmetric pattern.

In one embodiment of the sixth aspect, for each respective one of the electric dipole arrangement, the plurality of conductive elements are spaced apart generally equally.

In one embodiment of the sixth aspect, for each respective one of the electric dipole arrangement, the plurality of conductive elements have generally the same size and shape.

In one embodiment of the sixth aspect, the substrate integrated waveguide fed antenna array further comprises, for each respective one of the electric dipole arrangement, a plurality of further conductive elements each associated with a respective conductive element of the electric dipole arrangement. Each of the further conductive elements extend generally perpendicular to the plane and to the slotted conductive surface. The further conductive elements may be in the form of vias, via holes, pins, or like conductive means.

In one embodiment of the sixth aspect, for at least one, or each, of the electric dipole arrangement, the plurality of conductive elements are generally L-shaped conductive elements each having a corner portion, and, in plan view, the conductive elements are arranged at or near the corner portions of the generally L-shaped conductive elements. For the respective one or more electric dipole arrangement, the corner portions of the L-shaped conductive elements may be arranged adjacent each other (e.g., in facing relationship).

In one embodiment of the sixth aspect, the parasitic patch arrangement comprises a plurality of conductive patch assemblies arranged on the plane, and each of the respective conductive patch assembly is arranged around a respective one of the electric dipole arrangement.

In one embodiment of the sixth aspect, each of the respective conductive patch assembly comprises four or more conductive patches that are spaced apart from each other. In one example, each of the respective conductive patch assembly is comprised of or consists essentially of the four conductive patches.

In one embodiment of the sixth aspect, the conductive patches are arranged such that each conductive element is at least partly disposed between two respective conductive patches in the respective conductive patch assembly.

In one embodiment of the sixth aspect, each of the slot is a cross-shaped slot having first and second slot portions arranged generally perpendicular to each other. The first and second slot portions may have the same length and/or width. For each of the slots, the first and second slot portions may have different lengths and/or widths. The first and second slot portions may each be a dumbbell-shaped slot having an elongated central slot portion and enlarged slot portions at two ends of the elongated central slot portion.

In one embodiment of the sixth aspect, the substrate integrated waveguide fed antenna further comprises a substrate. The plurality of electric dipole arrangements and the plurality of parasitic patch arrangements are arranged on an outer surface of the substrate.

In one embodiment of the sixth aspect, the substrate integrated waveguide fed antenna further comprises a conductive surface arranged on the outer surface of the substrate, the conductive surface generally surrounds the plurality of electric dipole arrangements and the plurality of parasitic patch arrangements. Such conductive surface, the electric dipole arrangement, and the parasitic patch arrangement may be arranged as the same layer, e.g., formed by etching.

In one embodiment of the sixth aspect, the substrate is a first substrate layer. The substrate integrated waveguide comprises a second substrate layer, a plurality of via holes formed in the second substrate layer, and a conductive surface on the second substrate layer. The slotted conductive surface is disposed between the first substrate layer and the second substrate layer. The substrate integrated waveguide may further include one or more impedance matching elements, which may be in the form of vias, via holes, pins, or like conductive means.

In one embodiment of the sixth aspect, the conductive surface on the second substrate layer comprises a plurality of slots that are generally aligned with the slots of the slotted conductive surface.

In one embodiment of the sixth aspect, the slots of the conductive surface on the second substrate layer is larger than the slots of the slotted conductive surface. The slots of the conductive surface on the second substrate layer may have the same shape and/or size as the slots of the slotted conductive surface.

In one embodiment of the sixth aspect, the first substrate layer and the second substrate layer have generally the same dielectric constant and/or generally the same thickness.

In one embodiment of the sixth aspect, the substrate integrated waveguide fed antenna array is a dual-polarized antenna array.

In accordance with a seventh aspect of the invention, there is provided a communication device including the substrate integrated waveguide fed antenna of the fifth aspect. The communication device may be any information handling system or signal/data processing system, such as a base station, a computer, a mobile phone, a tablet computer, a smart watch, an IoT device, etc. The communication device may be particularly adapted for 5G applications. The communication device may be used for other applications too, for example, 3G, 4G, WiMAX, etc.

In accordance with an eighth aspect of the invention, there is provided a communication device including the substrate integrated waveguide fed antenna array of the sixth aspect. The communication device may be any information handling system or signal/data processing system, such as a base station, a computer, a mobile phone, a tablet computer, a smart watch, an IoT device, etc. The communication device may be particularly adapted for 5G applications. The communication device may be used for other applications too, for example, 3G, 4G, WiMAX, etc.

Other features and aspects of the invention will become apparent by consideration of the detailed description and accompanying drawings. Any feature(s) described herein in relation to one aspect or embodiment may be combined with any other feature(s) described herein in relation to any other aspect or embodiment as appropriate and applicable.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the invention will now be described, by way of example, with reference to the accompanying drawings in which.

DETAILED DESCRIPTION

Figure 1B:
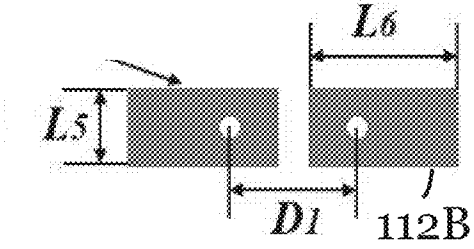
FIG. 1B is a plan view of the electric dipole of the antenna of FIG. 1A.
Figure 1A:
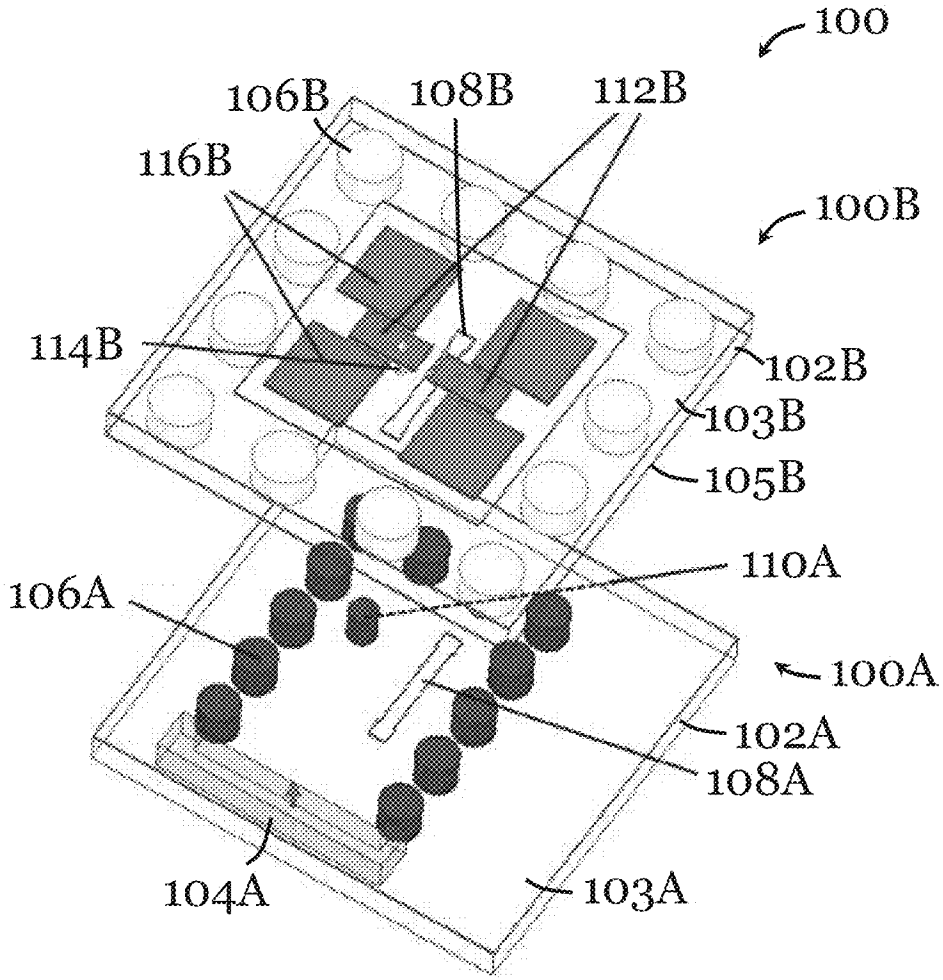
FIG. 1A is an exploded schematic view of a substrate integrated waveguide fed antenna in one embodiment of the invention.
Figure 2B:
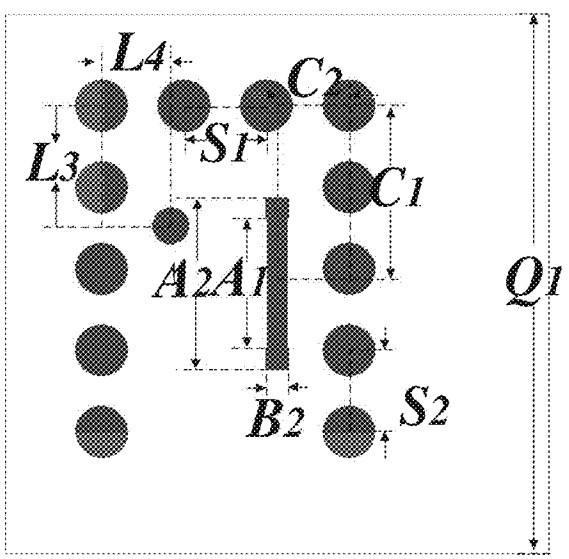
FIG. 2B is a schematic plan view of the lower substrate of the antenna of FIG. 1A.
Figure 2A:
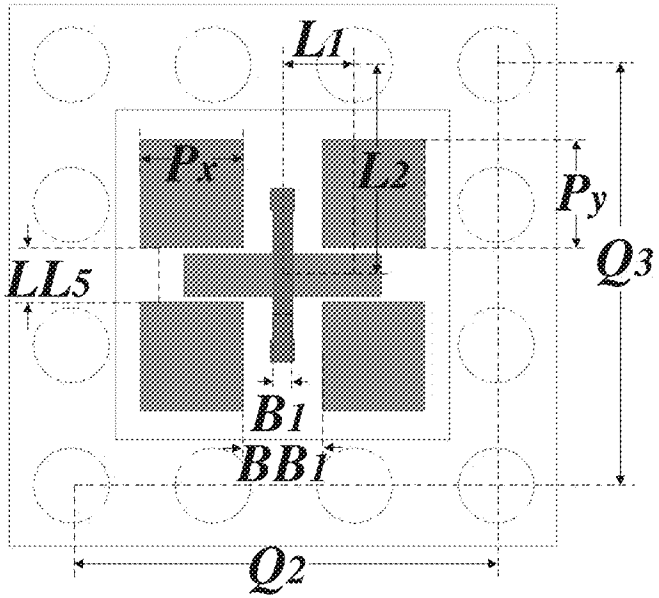
FIG. 2A is a schematic plan view of the upper substrate of the antenna of FIG. 1A.
Figure 2C:
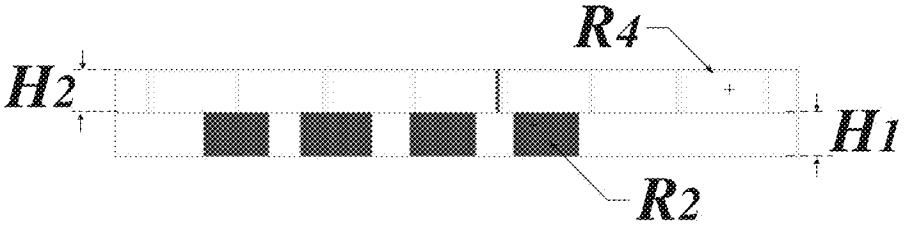
FIG. 2C is a side view of the antenna of FIG. 1A (when assembled)

FIGS. 1A to 2C show a substrate integrated waveguide fed antenna 100 in one embodiment of the invention. The antenna 100 includes two substrates, an upper substrate 100B and a lower substrate 100A. The lower substrate 100A is essentially a substrate integrated waveguide, which provides a feed structure. The lower substrate 100A includes a substrate layer 102A with an upper conductive surface 103A formed by copper. A feed port 104A and multiple vias 106A are arranged in, e.g., extend through, the substrate layer 102A. The vias 106A are arranged in a generally U-shaped array in plan view. The upper conductive surface 103A is a slotted conductive surface having a dumbbell shaped slot 108A. This dumbbell shaped slot 108A is arranged to be aligned and operably coupled with another dumbbell shaped slot 108B formed on the lower conductive surface of the upper substrate 100B. In this example, the two dumbbell shaped slots 108A, 108B have similar form (an elongated central slot portion+enlarged slot portions at two ends of the elongated central slot portion) but different sizes. An impedance matching post 110A is arranged in the substrate layer 102A of the lower substrate 100A, laterally between the dumbbell shaped slot 108A and a row of vias 106A in plan view, to affect the distribution of the electromagnetic wave and hence to facilitate impedance matching. The upper substrate 100B includes a substrate layer 102B with an upper conductive surface 103B formed by copper and a lower conductive surface 105B formed by copper. As mentioned, the lower conductive surface 103B formed by copper is a slotted conductive surface with a dumbbell shaped slot 108B aligned and operably coupled with another dumbbell shaped slot 108A formed on the upper conductive surface 103A of the lower substrate 100A. The dumbbell-shaped slots 108A, 108B are arranged to avoid introducing resonances outside the operating frequency band, preventing gain drop, as well as to facilitate energy coupling between the two substrates 100A, 100B to improve impedance matching. The substrate layer 102B includes multiple vias 106B arranged in a generally square shaped array in plan view. The upper conductive surface 103B includes a loop portion that defines a substrate integrated waveguide cavity. An electric dipole and a parasitic patch arrangement operably coupled with the electric dipole are arranged in the cavity. The electric dipole is formed by a pair of elongated dipole arms 112B, in the form of conductive patches that are spaced apart from each other and are aligned along an axis. The axis extends substantially perpendicularly to the slot 108B and crosses the slot 108B in plan view. Two conductive pins 114B, e.g., vias or posts, each associated with a respective dipole arm 112B, extends generally perpendicular to the plane and to the slotted conductive surface. The conductive pins 114B are arranged on opposite sides of the dumbbell-shaped slot 108B in plan view. The parasitic patch arrangement includes four parasitic patches 116B, arranged in two pairs, all spaced apart and arranged in the cavity. The patches 116B are arranged such that each dipole arm 112B is partly sandwiched between two respective parasitic patches 116B. The upper conductive surface 103B, the electric dipole 112B, and the parasitic patch arrangement 116B may be arranged in the same layer, e.g., formed by etching.

In this embodiment, both substrate layers 102A, 102B have a relative dielectric permittivity $\varepsilon_r$ of 2.2, a loss tangent $\delta$ of 0.0009, and a thickness $H_1$, $H_2$ of 0.787 mm. The conductive copper surfaces 103A, 103B, 105B each have a thickness t of 9 μm. Exemplary dimensions of the substrate integrated waveguide fed antenna as labeled in FIGS. 1B to 2C are given in Table I.

TABLE I

| Dimension of the antenna element (unit: mm) | | | | | | | |
|---|---|---|---|---|---|---|---|
| Parameter | $Q_1$ | $Q_2$ | $Q_3$ | $L_1$ | $L_2$ | $L_3$ | $L_4$ |
| Value | 12.56 | 9.75 | 9.75 | 1.65 | 4.875 | 2.8 | 1.6 |
| Parameter | $L_5$ | $L_6$ | $LL_5$ | $B_1$ | $B_2$ | $BB_1$ | $P_x$ |
| Value | 1 | 2.05 | 1.26 | 0.43 | 0.54 | 1.82 | 2.4 |
| Parameter | $P_y$ | $R_1$ | $R_2$ | $R_3$ | $R_4$ | $A_1$ | $A_2$ |
| Value | 2.52 | 0.42 | 0.6 | 0.15 | 0.87 | 3 | 4 |
| Parameter | $C_1$ | $C_2$ | D1 | $S_1$ | $S_2$ | | |
| Value | 4.15 | 1.65 | 1.75 | 1.9 | 1.95 | | |

Simulations were conducted by using a 3D electromagnetic (EM) simulation software Ansoft HFSS. Further details of the simulations are provided below.

Figure 3:
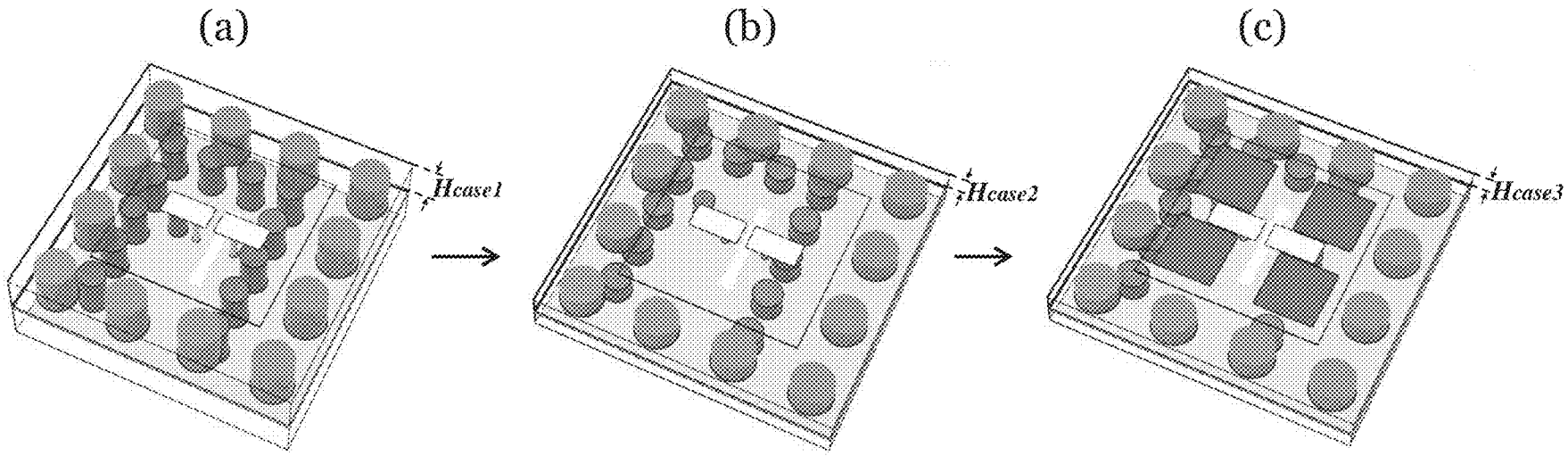
FIG. 3 is a schematic diagram illustrating the design process of the antenna of FIG. 1A.

The design process of the antenna is illustrated in FIG. 3, in 3 steps (a) to (c). In step (a), a substrate integrated waveguide fed antenna with the slot-fed dipole with cavity is used as a starting point. The dipole is around $0.25\lambda_s$ from the slot ($\lambda_s=\lambda_0/\sqrt{\varepsilon_r}$ where $\lambda_0$ is one free-space wavelength at 28 GHz). The thickness of the substrate $H_{case1}$=1.8 mm. Then, in step (b), the thickness is reduced to around $0.1\lambda_s$. The thickness of the substrate $H_{case2}=H_1$=0.787 mm. Finally, in step (c), two pairs of patches coupled by narrow gaps are added on the upper surface in the cavity. The thickness of the substrate $H_{case3}=H_{case2}=H_1$=0.787 mm.

Figure 4:
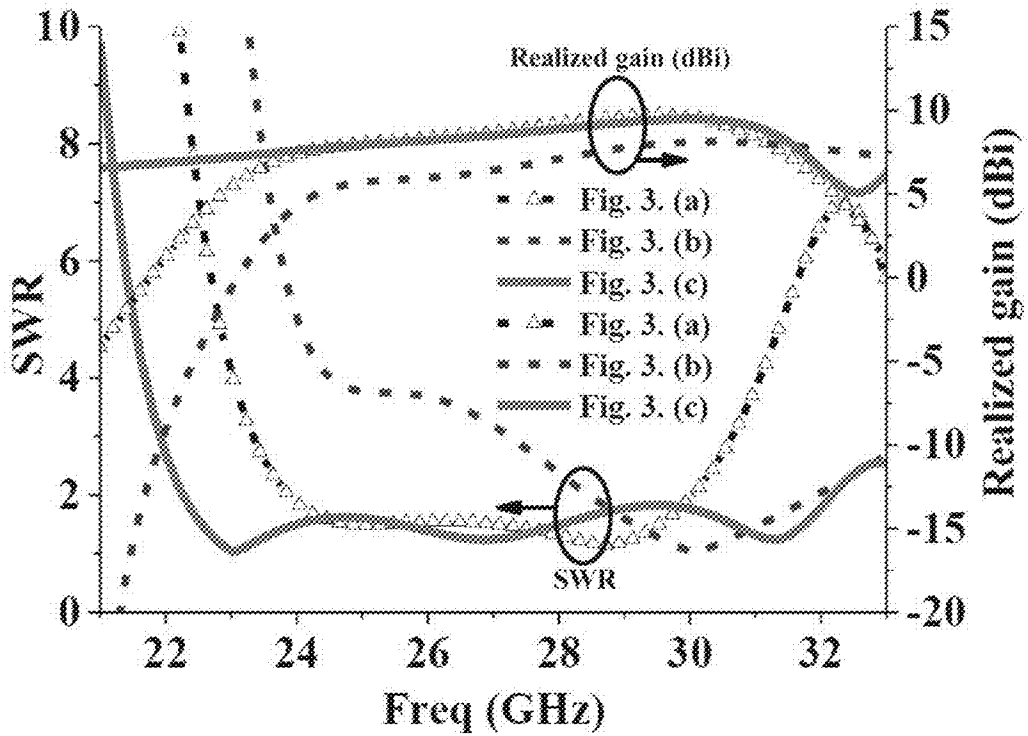
FIG. 4 is a graph showing variations of the standing wave ratio (SWR) and the antenna gain (dBi) of the antenna for different frequencies in different stages of the design in FIG. 3.

FIG. 4 shows the performance (SWR vs frequency; realized gain vs frequency) of the antenna at different steps of FIG. 3. As shown in FIG. 4, when the thickness of the substrate is reduced, the antenna gain drops and the impedance bandwidth narrows. When two pairs of parasitic patches coupled by narrow gaps are added, the effective aperture is expanded, the antenna gain is increased, and a wider impedance bandwidth is obtained.

Figure 5:
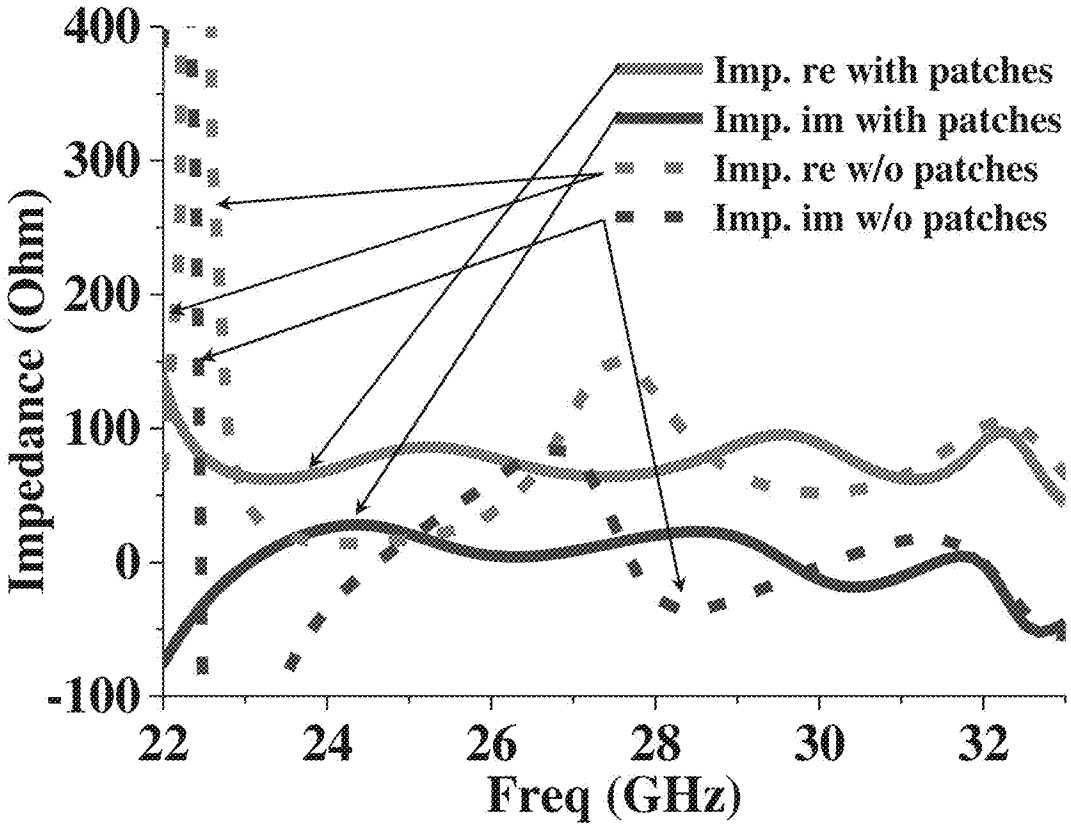
FIG. 5 is a graph showing the impedance of the electric dipole in the antenna of FIG. 1A with and without the parasitic patches.

FIG. 5 illustrates the effect on impedances at different frequencies without (FIG. 3, step (b)) and with (FIG. 3, step (c)) the parasitic patches. As shown in FIG. 5, the inclusion of the four parasitic patches flattens both the real and imaginary parts of the antenna input impedance. The real part fluctuates between 50Ω to 70Ω from 22 GHz to 32 GHz. In contrast, the real part of the impedance without the patches varies from a few ohms to over 400Ω in the same frequency range. The parasitic patches also introduce additional resonances. They behave inductively and/or capacitively, depending on the frequency, to flatten the reactance due to the slot and dipole alone.

Parametric studies have been performed on the antenna of FIGS. 1A to 2C by varying the length of the electric dipole arm ($L_6$), the length of the slot ($A_2$), and the length of the parasitic patch ($P_y$). In these studies one parameter is varied at a time (i.e., the other parameters are fixed/unchanged). The results are shown in FIGS. 6A to 6C.

Figure 6A:
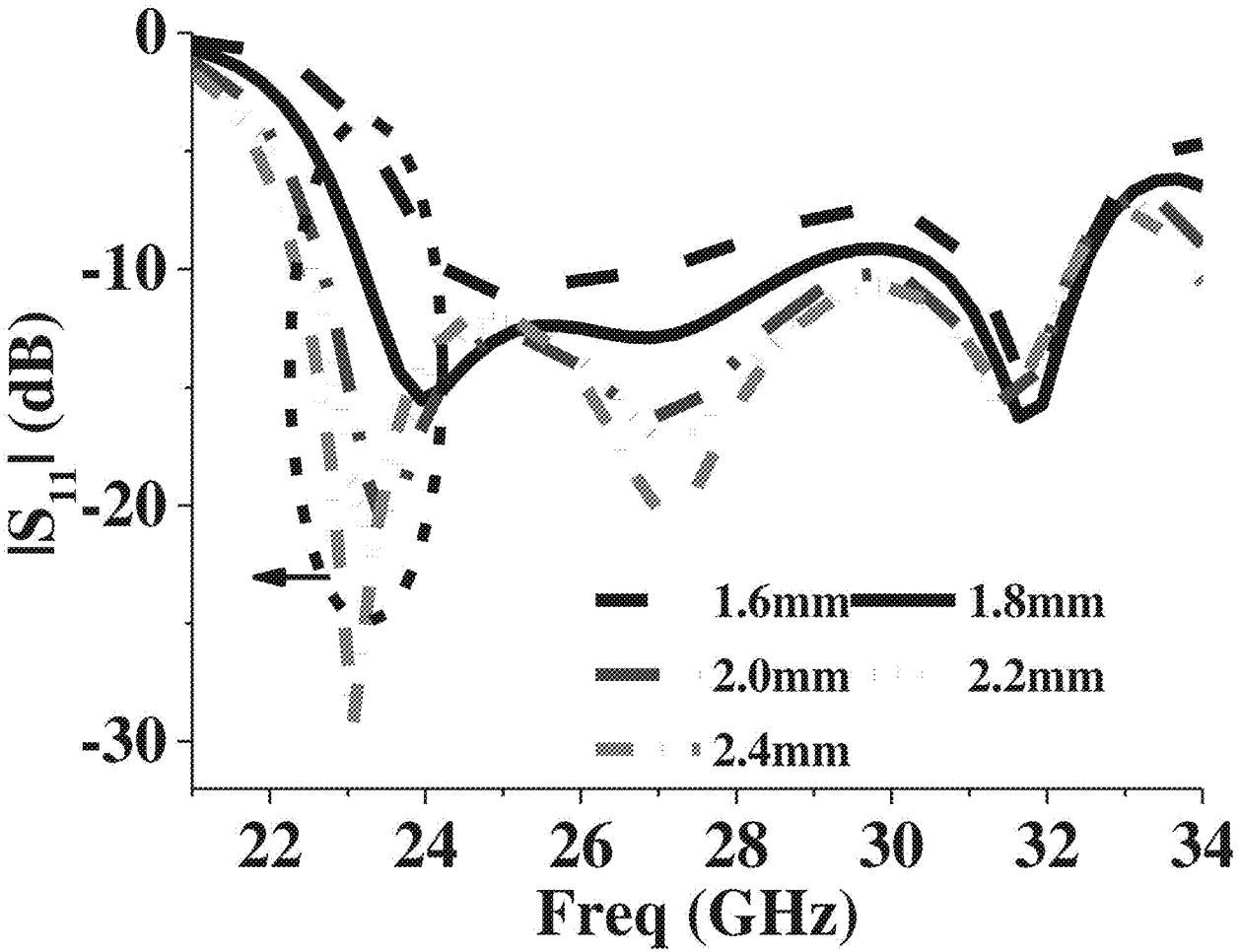
FIG. 6A is a graph showing a variation of the simulated reflection coefficient |S11| for different frequencies as a function of the length $L_6$ of the electric dipole arm in the antenna of FIG. 1A.
Figure 6B:
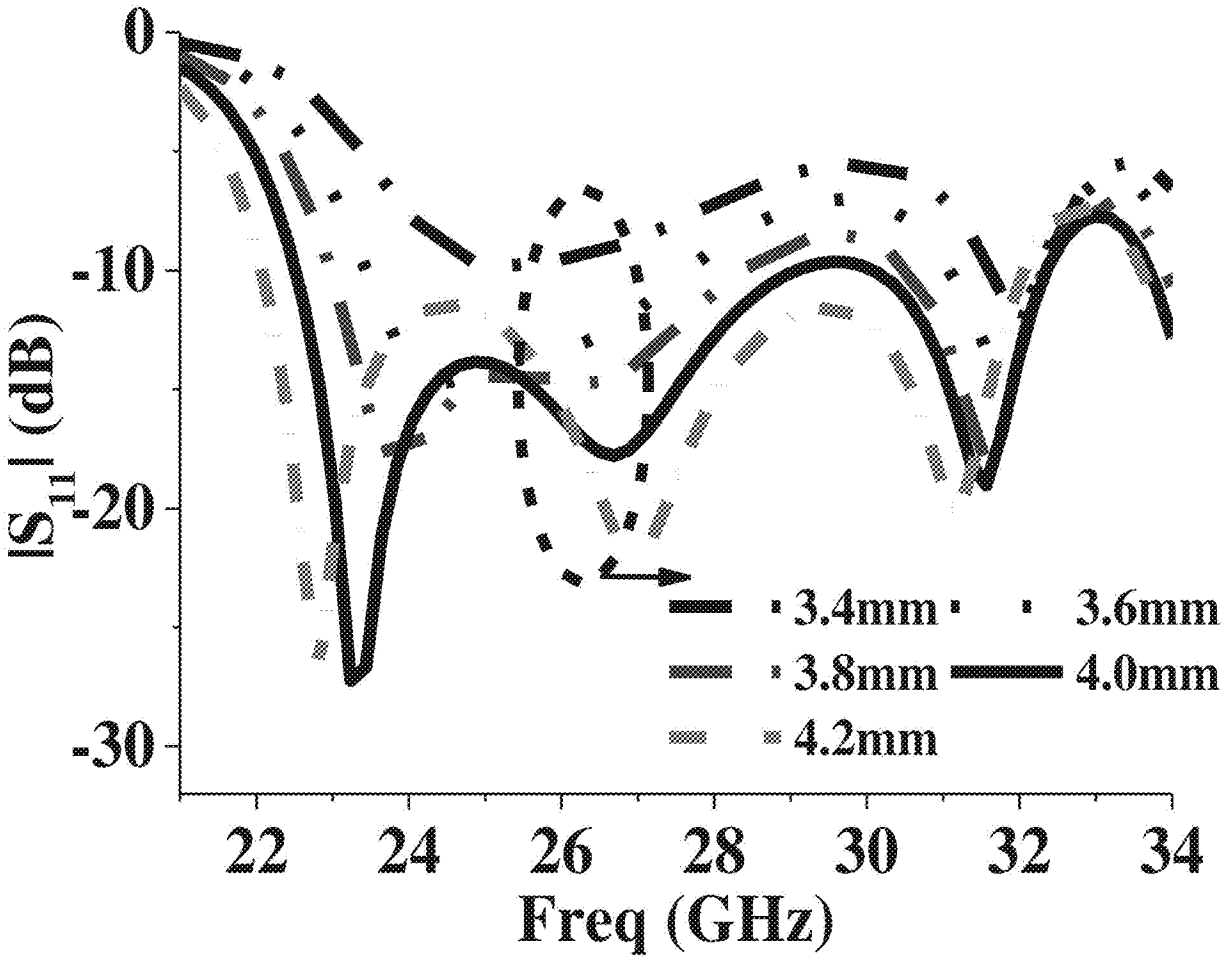
FIG. 6B is a graph showing a variation of the simulated reflection coefficient |S11| for different frequencies as a function of the length $A_2$ of the dumbbell-shaped slot in the lower substrate in the antenna of FIG. 1A.
Figure 6C:
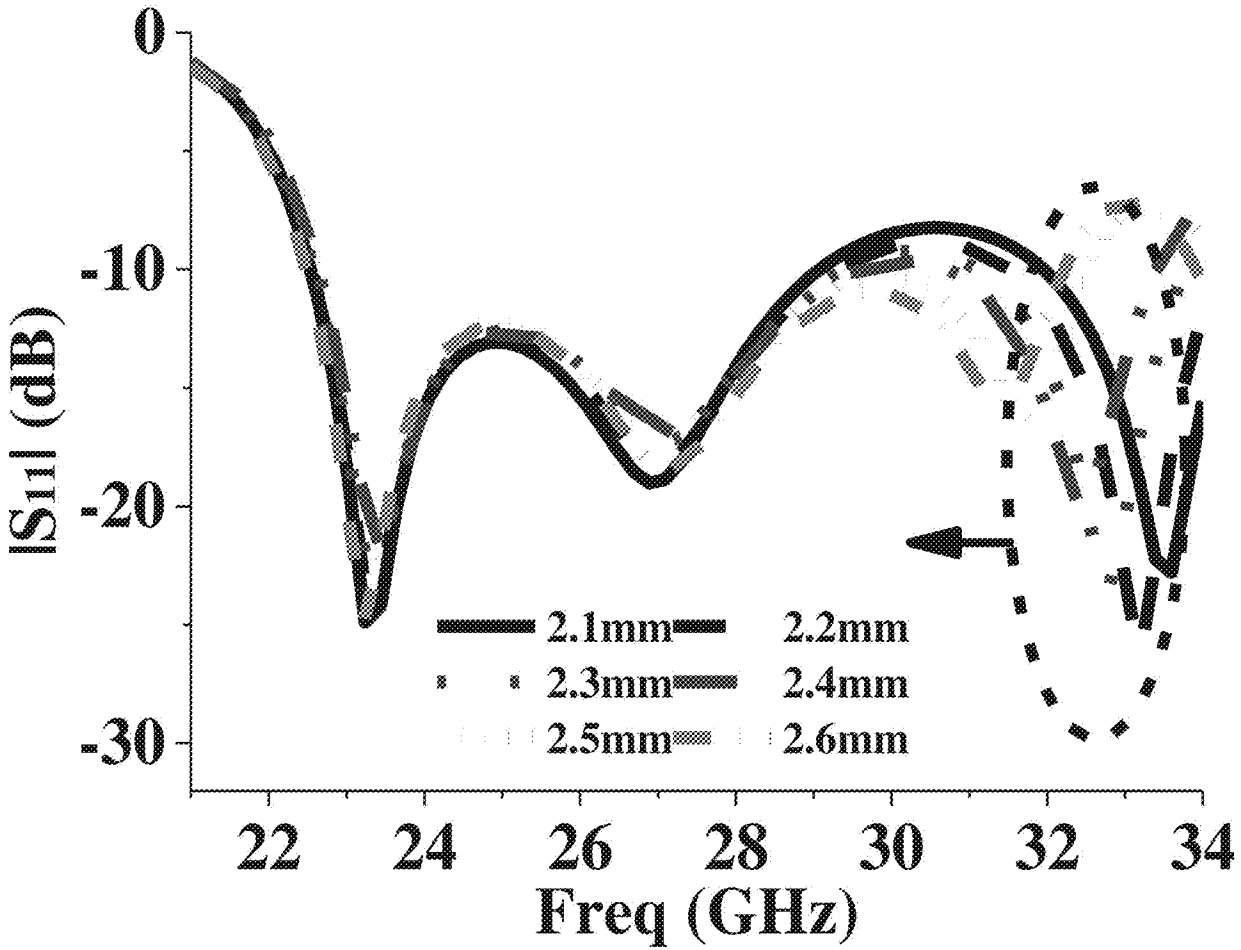
FIG. 6C is a graph showing a variation of the simulated reflection coefficient |S11| for different frequencies as a function of the length $P_y$ of the parasitic patch in the antenna of FIG. 1A.

In FIG. 6A, as the length of the electric dipole arm $L_6$ increases, the first resonance moves to lower frequencies while the other two resonances are not seriously affected. In FIG. 6B, when length of the slot $A_2$ increases, it impacts all the three resonances, and in particular the second resonance. It should be noted that the lengths of the electric dipole arm and the dumbbell shaped slot are inter-dependent, as the dumbbell shaped slot will determine the current, E-field strength, and distribution from the excitation, which in turn affects the performance of the dipole. However, the second resonance is influenced most by the length of slot $A_2$. With the four parasitic patches added, the length of the patch $P_y$ impacts only the third resonance as shown in FIG. 6C. This implies that the resonance is generated by the parasitic patches. The remaining parameters in Table I have been optimized for antenna performance in this embodiment. $L_6$, $A_2$, and $P_y$ are found to be the three parameters that have most influence on the antenna performance.

Figures 7A, 7B:
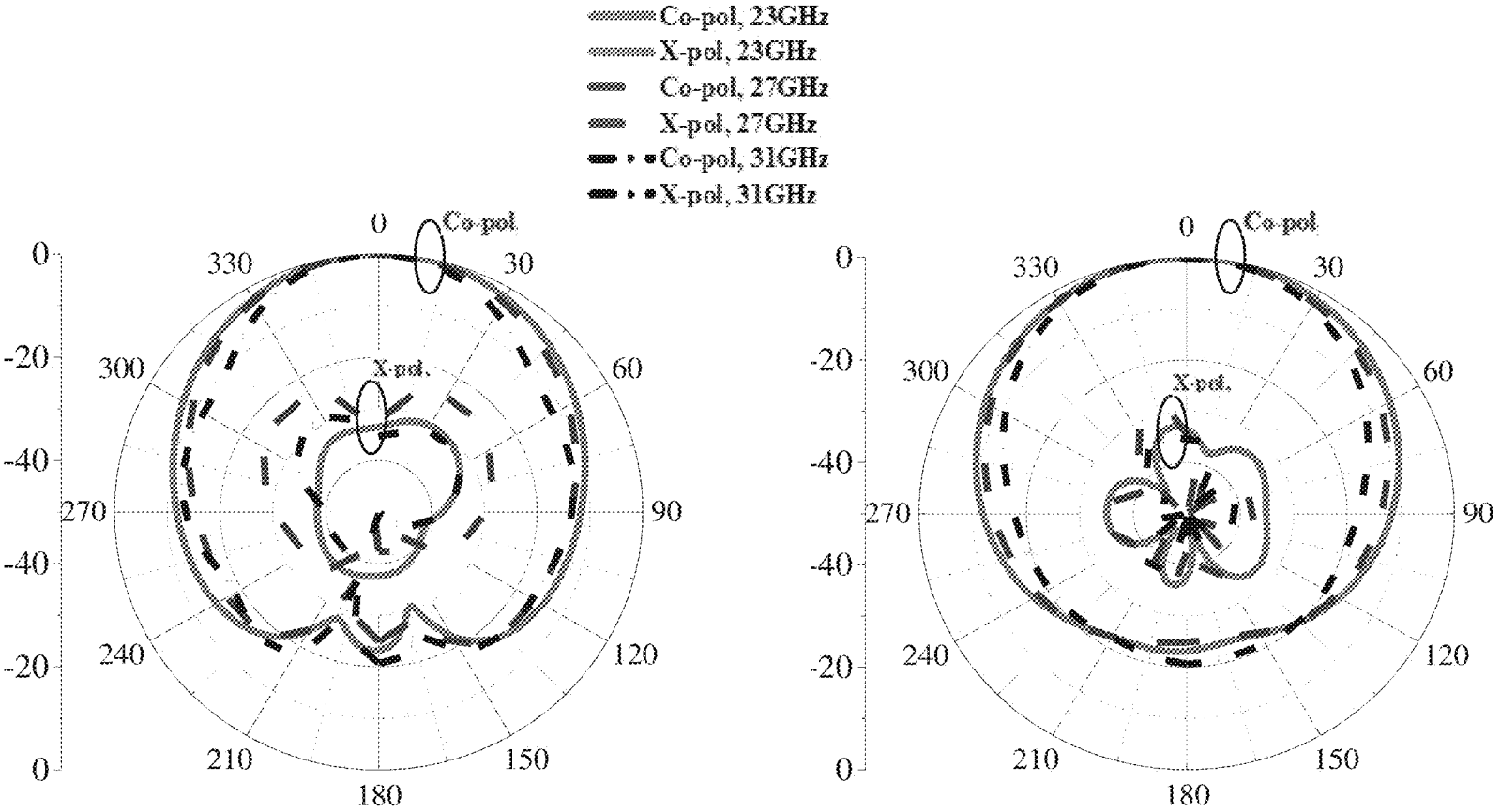
FIG. 7A is a plot showing a simulated E-plane radiation pattern of the antenna of FIG. 1A at 23 GHz, 27 GHz, and 31 GHz.
FIG. 7B is a plot showing a simulated H-plane radiation pattern of the antenna of FIG. 1A at 23 GHz, 27 GHz, and 31 GHz.

The antenna design with the parameters in Table I can achieve a simulated bandwidth of over 36% for standing wave ratio <2 (from 22.3 GHz to 32.1 GHz). The solid lines in FIG. 4 show the standing wave ratio and gain of it. The peak gain can reach up to 9.6 dBi at around 30 GHz. FIGS. 7A and 7B show the stable radiation patterns in both E-plane and H-plane at 23 GHz, 27 GHz, and 31 GHz respectively. In this embodiment the antenna structure has a relatively low cross-polarization provided by a relatively thin substrate of about $0.1\lambda_s$. The differential currents on the two shorting vertical vias have little impact on the main horizontal currents on the electric dipole and the parasitic patches, leading to a low cross-polarization of less than −25 dB.

Referring back to FIGS. 1A to 2C, the general working mechanism of the antenna 100 is as follows. In the antenna 100, the dumbbell shaped slot 108A, 108B provides a differential feeding mechanism to the dipole (formed by a pair of elongated dipole arms 112B) and the dipole in turn drives the four operably coupled parasitic patches 116B. The amount of induced currents on the four patches 116B depends on the gap width between the patch 116B and the dipole arms 112B as well as the operating frequency. When the current on the dipole reverses its direction during an oscillation cycle, the currents on the four patches 116B will follow but with a delay. The amount of delay is frequency dependent.

Figures 8A, 8B, 8C, 8D, 8E, 8F:
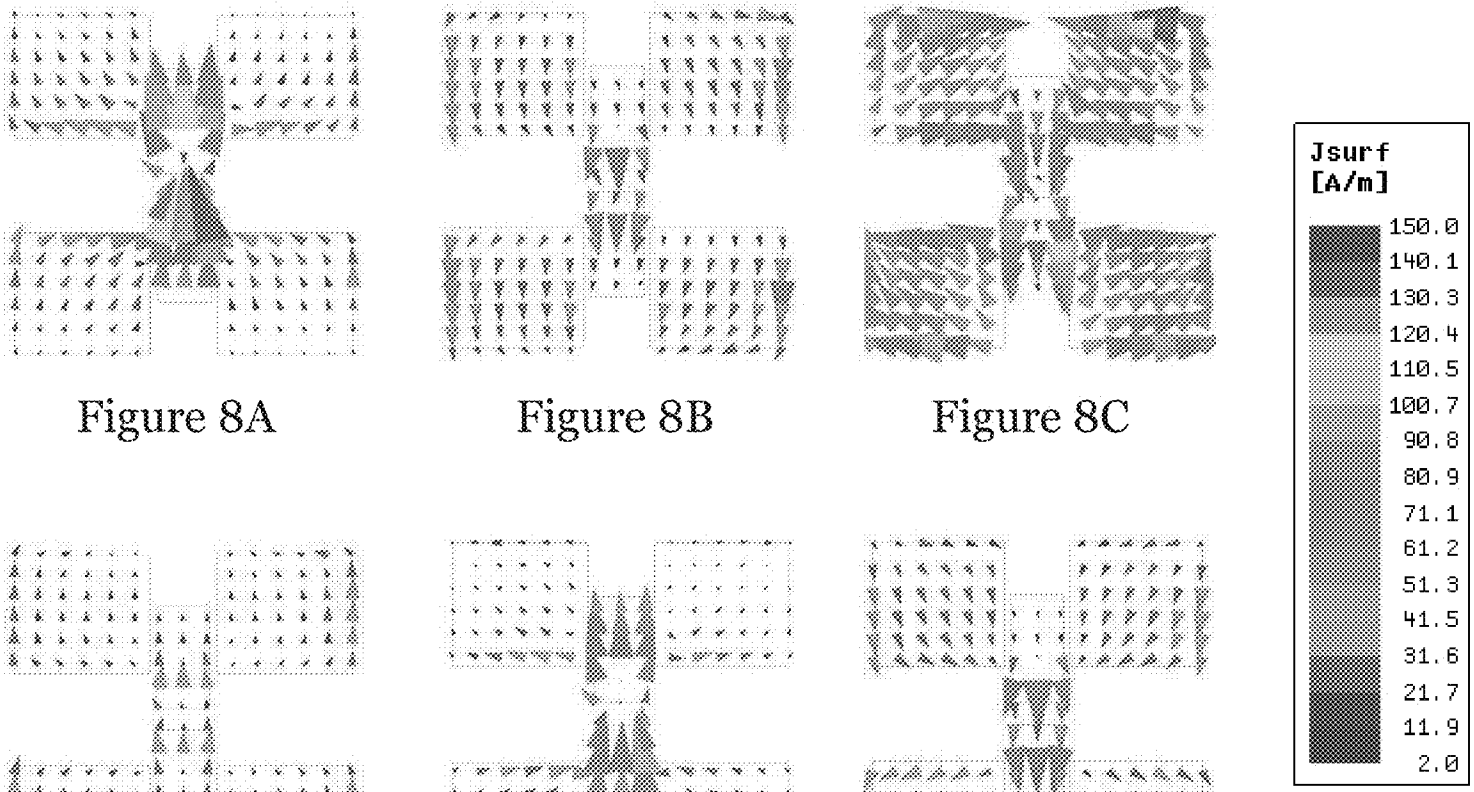
FIG. 8A is a plot showing current distribution at the first resonance (23.05 GHz) shown in FIG. 5 when time t=0 of an oscillation period T.
FIG. 8B is a plot showing current distribution at the second resonance (27.13 GHz) shown in FIG. 5 when time t=0 of an oscillation period T.
FIG. 8C is a plot showing current distribution at the third resonance (31.32 GHz) shown in FIG. 5 when time t=0 of an oscillation period T.
FIG. 8D is a plot showing current distribution at the first resonance (23.05 GHz) shown in FIG. 5 when time t=T/4 of an oscillation period T.
FIG. 8E is a plot showing current distribution at the second resonance (27.13 GHz) shown in FIG. 5 when time t=T/4 of an oscillation period T.
FIG. 8F is a plot showing current distribution at the third resonance (31.32 GHz) shown in FIG. 5 when time t=T/4 of an oscillation period T.

FIGS. 8A to 8F show the current distributions on the dipole and the four patches 116B at the three resonances (23.05 GHz, 27.13 GHz, 31.32 GHz) shown in FIG. 5. FIGS. 8A to 8C show the current distribution at time t=0 at the respective resonances, and FIGS. 8D to 8F show the current distribution at time t=T/4 at the respective resonances, respectively. The currents at t=T/2 and t=3 T/4 (not shown) are identical to that of t=0 and t=T/4, respectively, except for the reversal of the current directions. Here T is one period of the oscillation at the designated frequency. It is evident from the Figures that the horizontal components of the patch currents generally always cancel each other out, leading to a very low cross-polarization level.

At the first resonance of 23.05 GHz, the induced currents on the patches 116B are small compared to the dipole current at t=0. The radiation is mainly contributed by the dipole. The vertical components of the patch currents, however, are in the same direction as the dipole current. At t=T/4, vertical components of the patch currents and dipole current are comparable and they radiate constructively.

At the second resonance of 27.13 GHz, the dipole currents and the patch currents are of similar amplitude at t=0 and the radiation is contributed by both the dipole and the patches 116B as the vertical components of the currents are in the same direction also. At t=T/4, the dipole current dominates. Although not shown, at t=0.56 T, the patch currents dominate. Therefore, both the dipole and patches 116B contribute to the radiation. It also demonstrates that the reversal of current directions on the patches 116B depends on frequency.

At the third resonance at 31.32 GHz, the patch currents are slightly stronger than that of the dipole at t=0. More importantly, the vertical components of the patch currents are opposite to the dipole current. While the vertical currents on the dipole and the patches 116B are in the same direction at t=T/4 except that the amplitude is smaller. The slight cancelation in the vertical currents explains the gain drop at the third resonance shown in FIG. 4.

Table II shows the performance parameters of the antenna 100. The antenna is low-profile and has a low-cross polarization level without little reduction in operating bandwidth. The use of an SIW feeding structure makes it easy to construct array for high gain applications.

TABLE II

Performance of the antenna

| Type | Impedance Bandwidth | Peak Gain (dBi) | Element Thickness ($\lambda_s$) | X-pol Level (dB) |
|---|---|---|---|---|
| Aperture coupled dipole with parasitic patches | 36.0% | 9.6 | 0.1 | ~−25 |

Figure 9B:
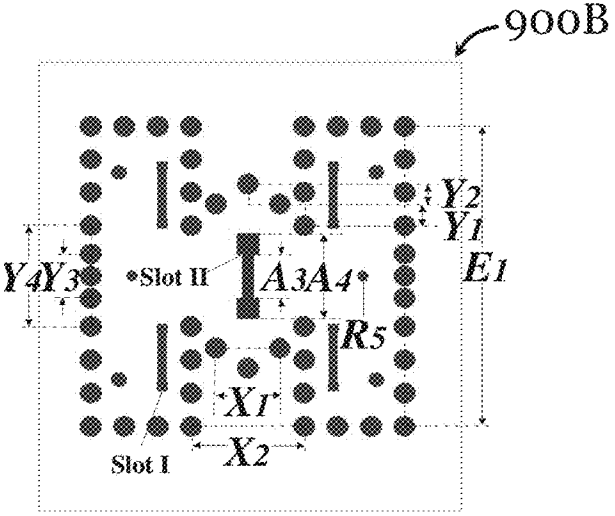
FIG. 9B is a schematic plan view of the middle substrate of a substrate integrated waveguide fed antenna in one embodiment of the invention.
Figure 9A:
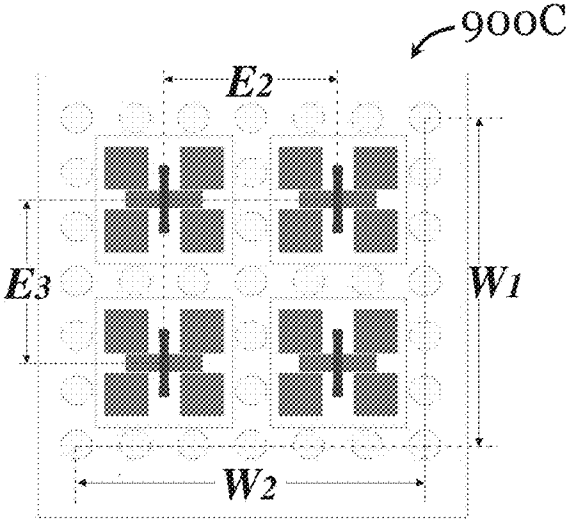
FIG. 9A is a schematic plan view of the upper substrate of a substrate integrated waveguide fed antenna in one embodiment of the invention.
Figure 9C:
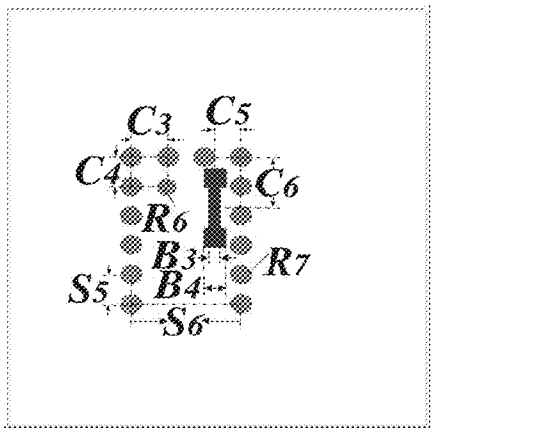
FIG. 9C is a schematic plan view of the lower substrate of a substrate integrated waveguide fed antenna in one embodiment of the invention.

FIGS. 9A to 9C show three substrates of a substrate integrated waveguide fed antenna in another embodiment of the invention. FIG. 9A is the upper substrate 900C, FIG. 9B is the middle substrate 900B, and FIG. 8C is the lower substrate 900A. The upper substrate 900C is basically a 2×2 array version of the upper substrate 100B in the antenna of FIGS. 1A to 2C. The upper substrate 900C has 4 (2×2) antenna elements, formed by 4 electric dipoles, each respectively operably coupled with parasitic patches on the same conductive surface and a dumbbell shaped slot on the opposite conductive surface. For each antenna element, the arrangement of the dipole/parasitic patch/slot is similar to that in FIGS. 1A to 2C. The 2×2 array is a uniform, regular array. The middle substrate 900B is essentially a four-way broad-wall coupler, with a substrate layer, and conductive surfaces on both sides. The middle substrate 900B facilities control of power and phase of the antenna elements. The lower conductive surface is a slotted conductive surface with a centrally arranged dumbbell shaped slot. The substrate layer has vias arranged to regular power transfer between the upper and lower substrate layers. The upper conductive surface is a slotted conductive surface with four dumbbell shaped slots each aligned with a respective dumbbell shaped slots in the lower conductive surface of the upper substrate, forming ports for transferring energy. The dumbbell-shaped slot on the lower conducive surface helps to spread energy to the four ports. As such the middle substrate 900B can be considered as a power divider or regulator. Each of the four ports excites the antenna element in the upper substrate, much like the embodiment of FIGS. 1A to 2C. The lower substrate 900A is substantially the same as the lower substrate layer 100A of the embodiment of FIGS. 1A to 2C.

Figure 9D:
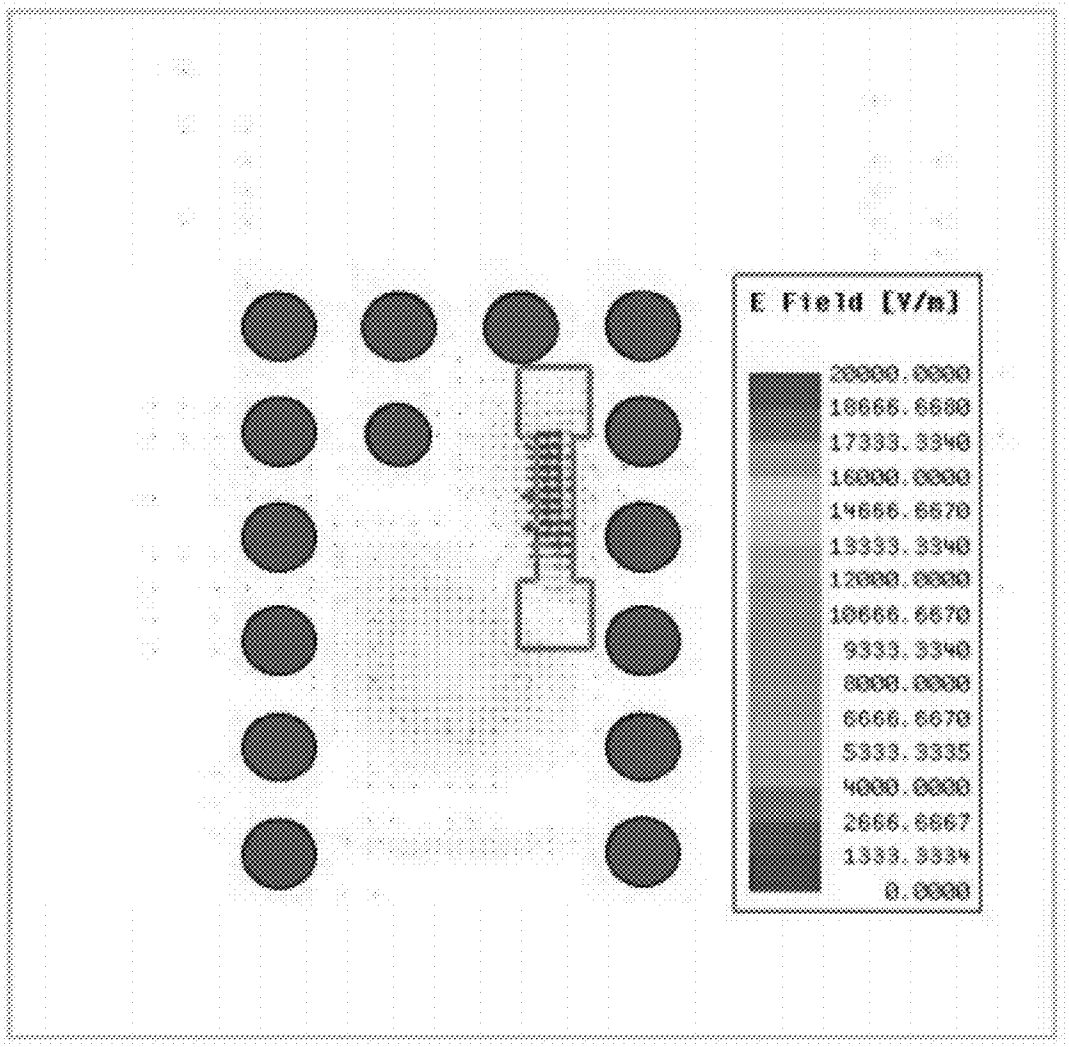
FIG. 9D is a graph showing an E-field plot at the slot in the lower substrate of FIG. 9C.

FIG. 9D shows the electrical field distribution of the dumbbell shaped slot of FIG. 9C, which illustrates the low cross-polarization of the antenna, i.e., a relatively uniform electric field orthogonal to the orientation of the slot.

Exemplary dimensions of the substrate integrated waveguide fed antenna as labeled in FIGS. 9A to 9C are given in Table III.

TABLE III

| Dimension of the subarray (unit: mm) | | | | | | | |
|---|---|---|---|---|---|---|---|
| Parameter | $R_5$ | $R_6$ | $R_7$ | $W_1$ | $W_2$ | $Y_1$ | $Y_2$ |
| Value | 0.3 | 0.53 | 0.6 | 19.5 | 19.5 | 1.3 | 1.2 |
| Parameter | $Y_3$ | $Y_4$ | $X_1$ | $X_2$ | $A_3$ | $A_4$ | $B_3$ |
| Value | 2.65 | 6.05 | 3.65 | 6.45 | 2.6 | 5.1 | 0.63 |
| Parameter | $B_4$ | $C_3$ | $C_4$ | $C_5$ | $C_6$ | $S_5$ | $S_6$ |
| Value | 1.25 | 2.05 | 1.95 | 1.5 | 3.3 | 1.9 | 6.3 |
| Parameter | $E_1$ | $E_2$ | $E_3$ | | | | |
| Value | 18.05 | 9.75 | 9.75 | | | | |

Figure 10:
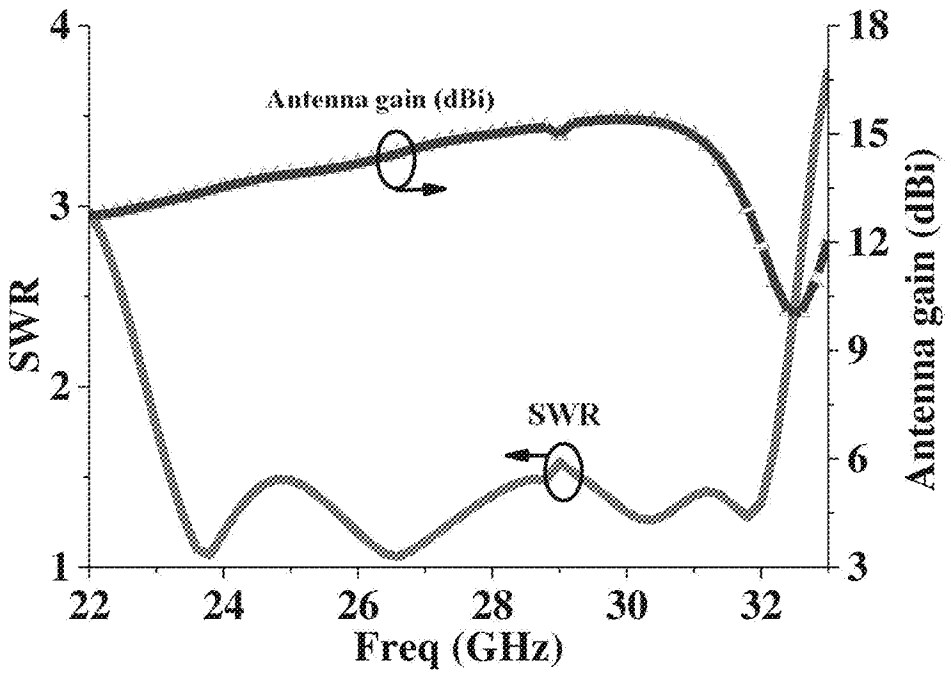
FIG. 10 is a graph showing the standing wave ratio (SWR) and the antenna gain (dBi) of the antenna formed by the substrates in FIGS. 9A to 9C.

FIG. 10 shows the simulated standing wave ratio (SWR) and gain of the antenna at different frequencies, with a bandwidth of 34% from 23 GHz to 32.5 GHz for standing wave ratio <2 and a peak gain of 15.3 dBi.

Figure 11B:
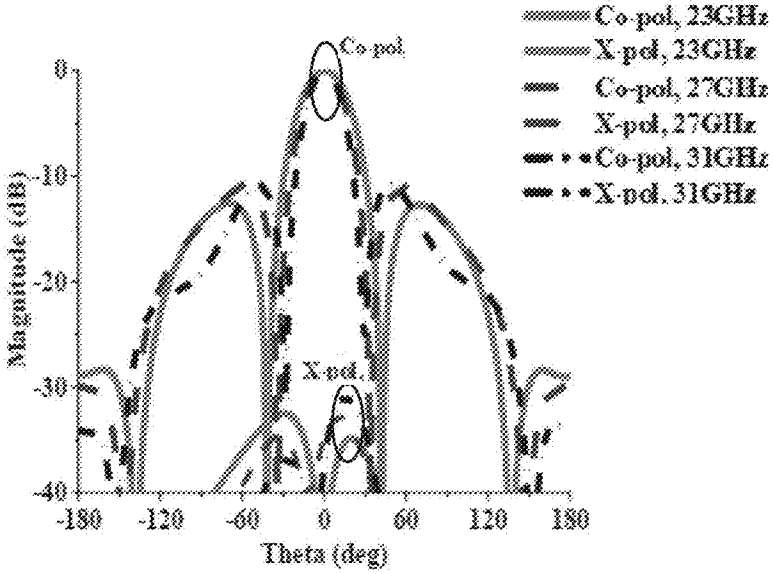
FIG. 11B is a graph showing a simulated H-plane radiation pattern of the antenna the antenna formed by the substrates in FIGS. 9A to 9C at 23 GHz, 27 GHz, and 31 GHz.
Figure 11A:
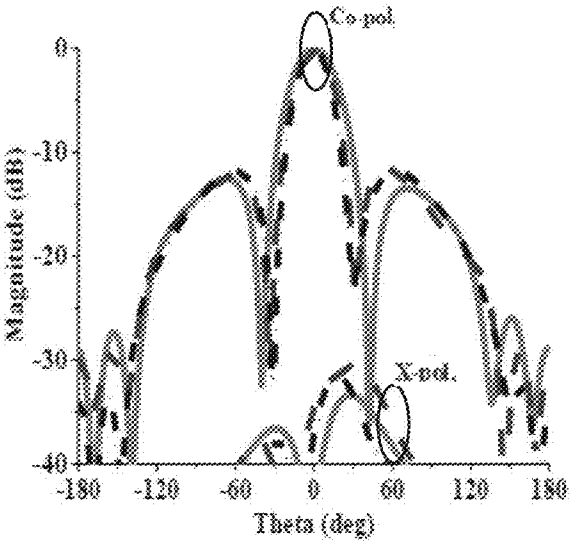
FIG. 11A is a graph showing a simulated E-plane radiation pattern of the antenna formed by the substrates in FIGS. 9A to 9C at 23 GHz, 27 GHz, and 31 GHz.

FIGS. 11A and 11B show the E- and H-plane radiation patterns of the antenna at 23 GHz, 27 GHz, and 31 GHz. As shown in FIGS. 11A and 11B, the radiation patterns are stable and the cross-polarization level is less than −30 dB. The E-plane and H-plane patterns are similar and the first sidelobe is around −13 dB for a four-way equal power divider.

Figure 12B:
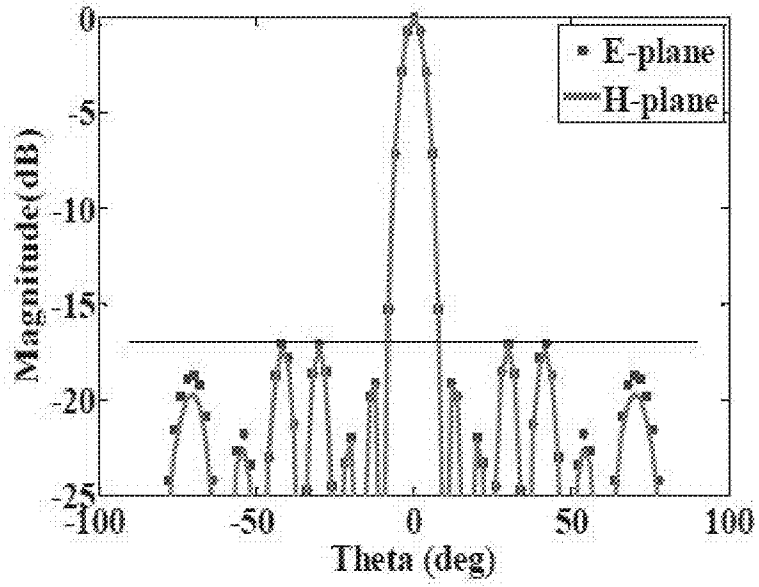
FIG. 12B is a graph showing the theoretical radiation pattern of the antenna array.
Figure 12A:
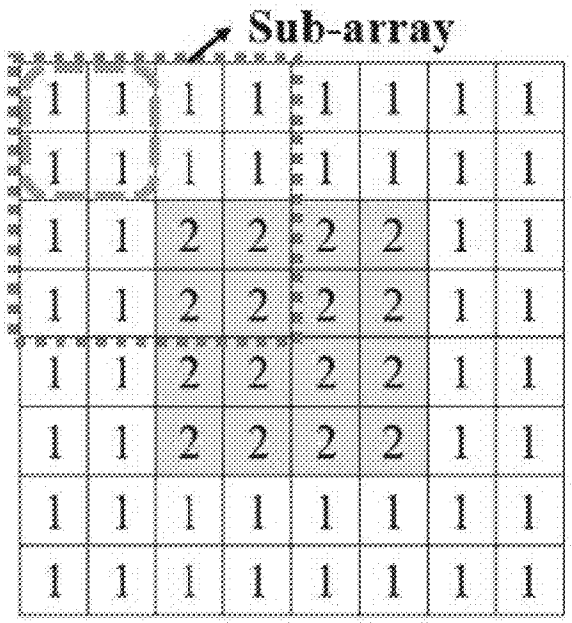
FIG. 12A is a plot illustrating power distribution of an antenna array in one embodiment of the invention.

In one embodiment of the invention, there is provided a substrate integrated waveguide fed antenna 1700, shown in FIG. 17 (described in further detail below), built upon the design in FIGS. 9A to 9C. In this embodiment, the antenna has an array of 8×8 antenna elements, with a multi-substrates (substrate layers) substrate integrated waveguide feeding network. FIGS. 12A and 12B illustrate a non-uniform power distribution and radiation patterns (at 8 GHz) for such an antenna. As shown in FIG. 12B, theoretical calculation of E- and H-plane radiation patterns at 28 GHz are similar and their side-lobes are all better than −17 dB.

Figure 13:
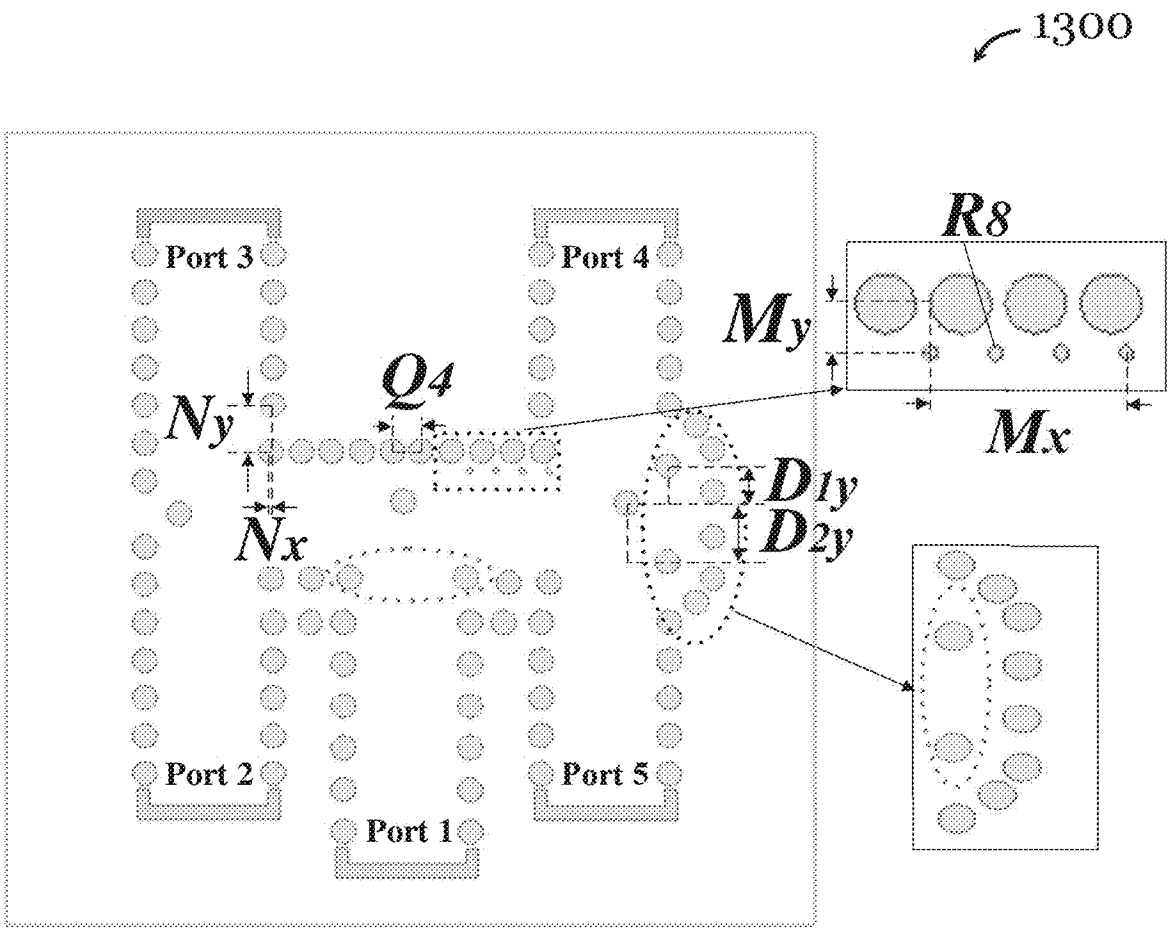
FIG. 13 is a schematic diagram of a sub-feeding network for unequal power distribution and with phase compensation in one embodiment of the invention.

FIG. 13 shows a sub-feeding network 1300 for unequal power distribution suitable and with phase compensation for use in the antenna. The sub-feeding network 1300 may be applied in the lower substrate of the substrate integrated waveguide feeding network. There is a substrate integrated waveguide input transition and the substrate integrated waveguide first goes through a four-way equal power divider. Each of the four branches (labelled as Port 1) then goes through a 1:1:1:2 power distribution for ports 2, 3, 4, and 5, respectively, as shown in FIG. 13. These ports will be fed by the sub-array enclosed by the short-dashed (larger) box in FIG. 12A. The antenna elements in the long-dashed (smaller) box in FIG. 12A have the same power excitation and phase through a four-way equal power divider as shown in FIG. 9B. The power divider for each of the 2×2 sub-arrays in FIG. 12A may be arranged in the upper layer of the feeding network. To achieve phase compensation, vias near an edge of the vias arrangement are arranged to form a blob. Exemplary dimensions of the sub-feeding network 1300 as labeled in FIG. 12 are given in Table IV. The design rationale of FIG. 12 is this: first adjust the key matching posts in the center of each T junction such that the power distribution of ports 3-5 has similar power and port 2 have about twice the power of the other ports 3-5. Then change the widths of the substrate integrated waveguide (e.g., the substrate) as illustrated in the two insets of FIG. 13 to control the respective propagation constants. Finally, the extra phase adjustment vias (shown in the central dotted box of FIG. 13) are moved via optimization to obtain a 1:1:1:2 power distributions for |S12|, |S13|, |S14|, and |S15| in FIG. 14A and equal phase in FIG. 14B.

TABLE IV

| Dimension of the sub-feeding network (unit: mm) | | | | |
|---|---|---|---|---|
| Parameter | $N_x$ | $N_y$ | $Q_4$ | $R_7$ |
| Value | 0.1 | 2.3 | 1.4 | 0.15 |
| Parameter | $M_x$ | $M_y$ | $D_{1y}$ | $D_{2y}$ |
| Value | 3.9 | 1 | 1.85 | 2.95 |

Figure 14A:
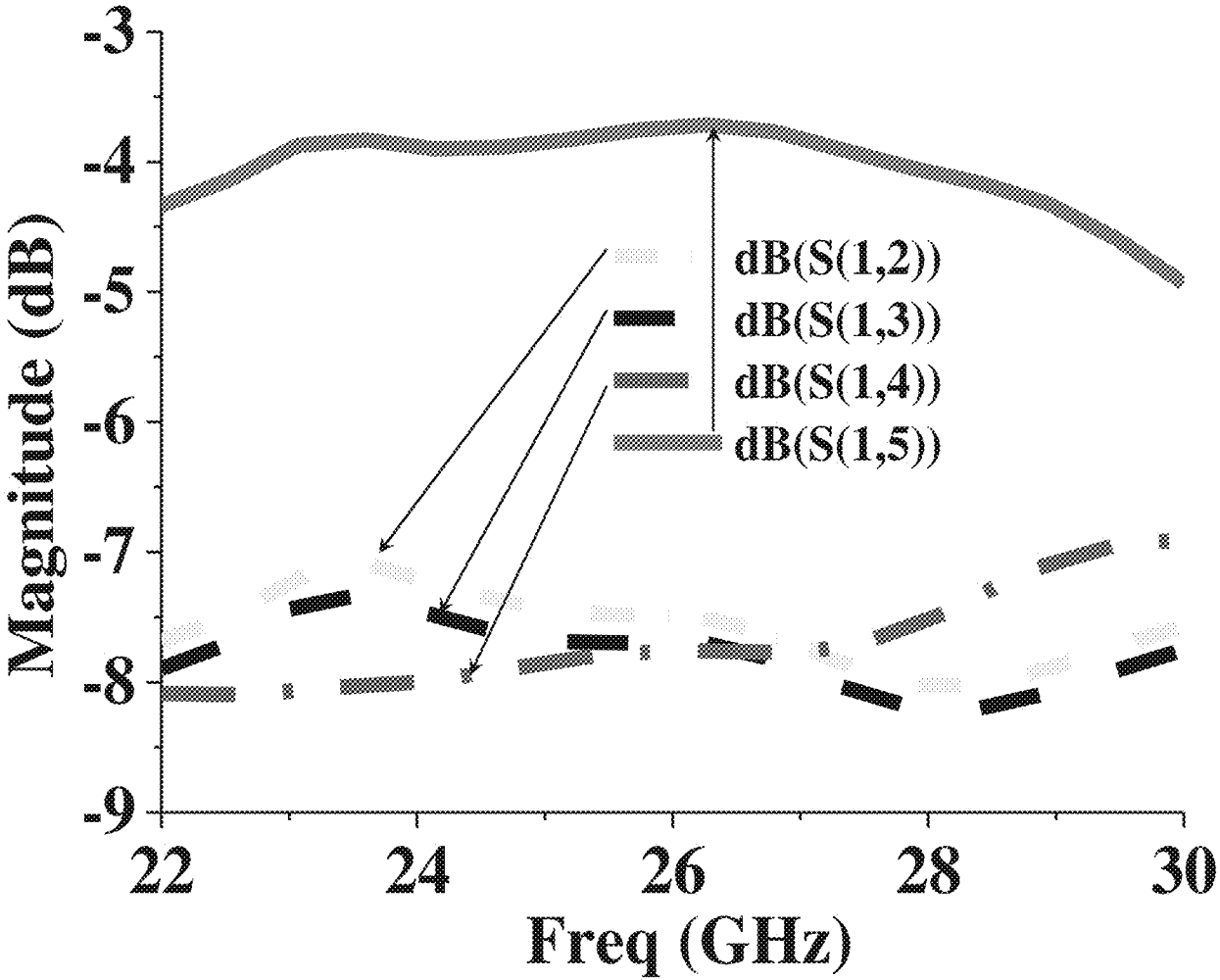
FIG. 14A is a graph showing the power output magnitudes (dB) at Ports 2 to 5 in FIG. 13 at different frequencies.
Figure 14B:
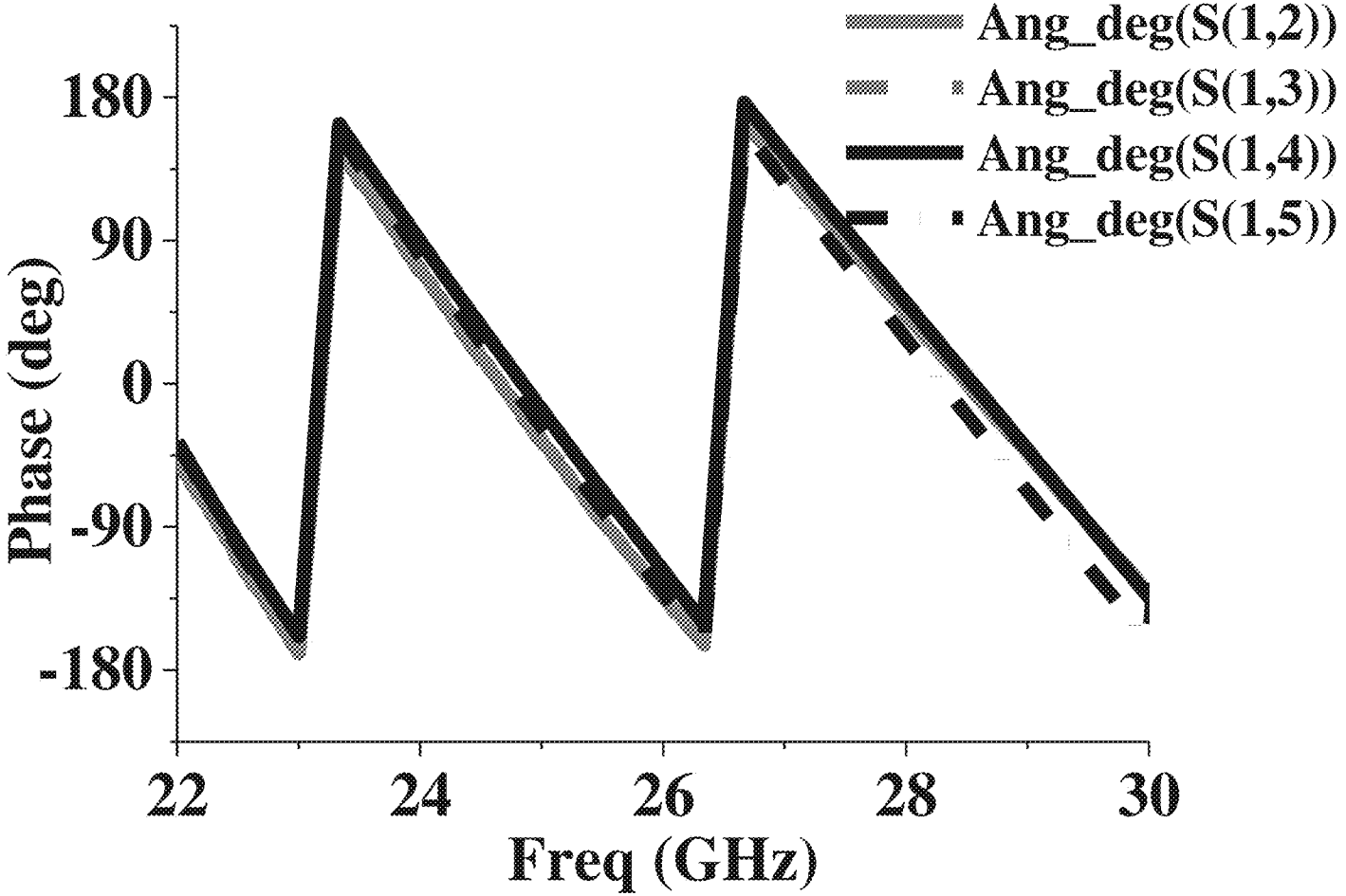
FIG. 14B is a graph showing the phase (deg) at Ports 2 to 5 in the sub-feeding network of FIG. 13 at different frequencies.

FIG. 14A shows the power distribution of the sub-feeding network 1300. FIG. 14A shows the magnitudes of S12, S13, S14, S15. The magnitude of S15 is about 3 dB higher than that of the S12, S13, and S14. FIG. 14B shows the equal phase outputs achieved by using the vias arrangement in FIG. 13.

In one example, an HD-260WACK adapter, operating from 21.7 GHz to 33 GHz, can be used to feed the antenna, e.g., at the input feed of the substrate integrated waveguide. The adapter can cover the whole working frequency of the antenna array. In the antenna of this embodiment, a substrate integrated waveguide to waveguide transition structure is used. Duroid 5880 substrate with thickness 0.787 mm is used. An extra substrate (layer) with thickness h=0.787 mm is added below to improve transition from waveguide to substrate integrated waveguide.

Figure 15B:
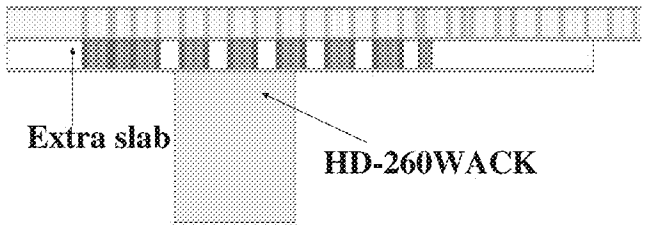
FIG. 15B is a schematic diagram of an input transition structure for a substrate integrated waveguide fed antenna array in one embodiment of the invention.
Figure 15A:
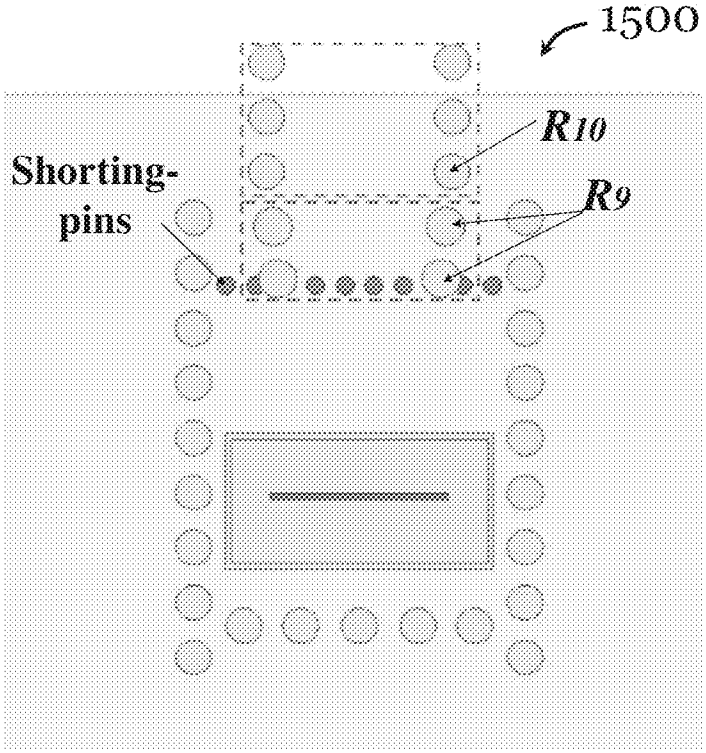
FIG. 15A is a schematic diagram of an input transition structure for a substrate integrated waveguide fed antenna array.
Figure 16B:
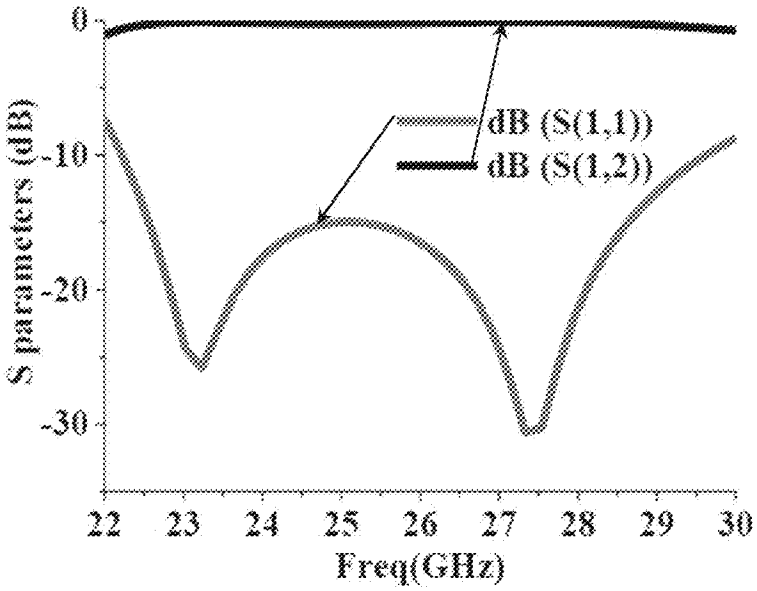
FIG. 16B is a graph showing the magnitudes of scattering parameters for the input transition structure of FIG. 15B.
Figure 16A:
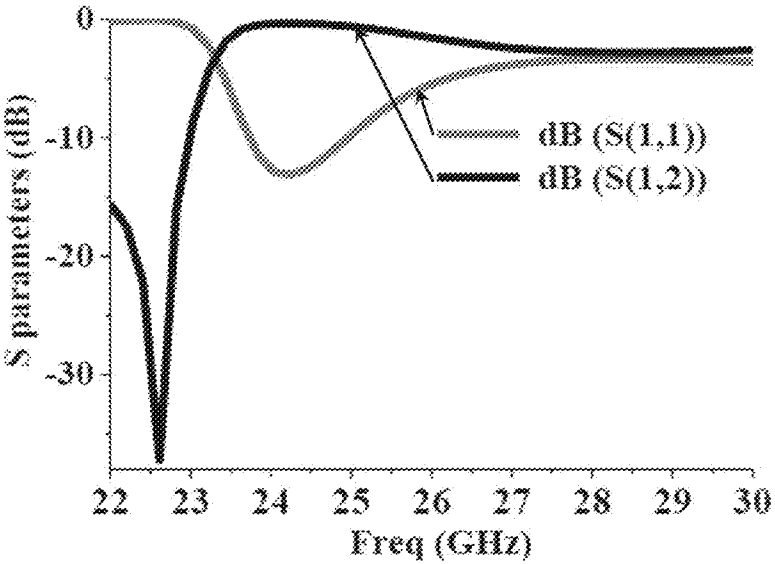
FIG. 16A is a graph showing the magnitudes of scattering parameters for the input transition structure of FIG. 15A.

FIGS. 15A and 15B show the detailed structure 1500 of the substrate integrated waveguide to waveguide transition. Four extra vias with larger radius are added, as shown in the lower dashed box of FIG. 15A ($R_9$=0.65 mm). The bottom two vias are separated by 5.48 mm. In the upper dashed box of FIG. 15A, there are six vias of radius $R_{10}$ (0.6 mm). The left and right vias are separated by 5.85 mm. This provides a better matching between the substrate integrated waveguide and the waveguide. A row of shorting pins (the dark grey vias) is applied to in the extra stub to reduce or prevent energy leakage, as shown in FIG. 15A. The magnitudes of scattering parameters with and without the additional substrate are shown in FIGS. 16A and 16B, respectively. A return loss of |S11|<−15 dB across the operating frequency band is achieved with the extra substrate.

Figure 17:
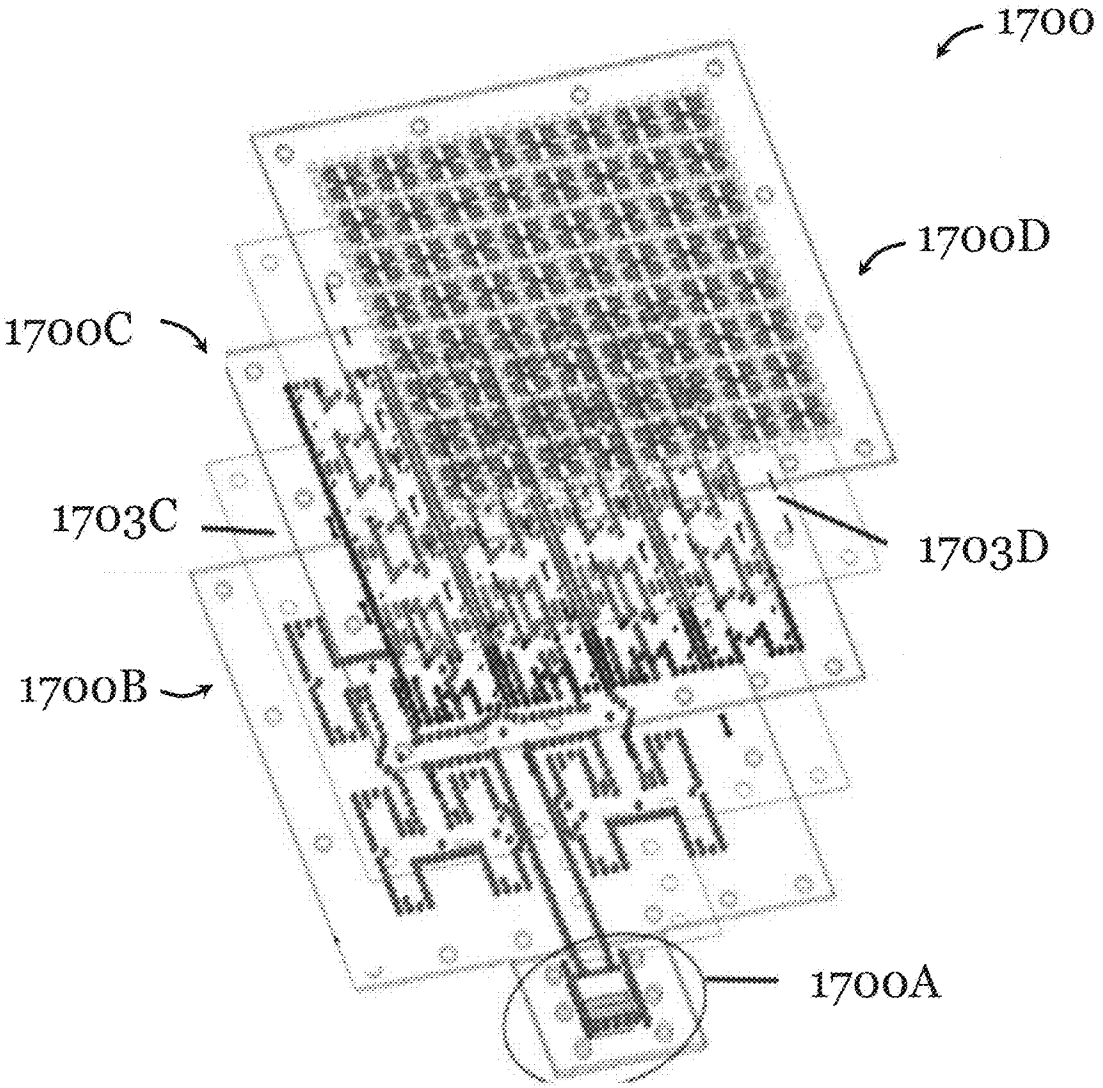
FIG. 17 is a schematic diagram of a substrate integrated waveguide fed antenna array in one embodiment of the invention.

FIG. 17 shows the antenna 1700 described above, with an 8×8 antenna elements array. The antenna 1700 includes four substrates 1700A-1700D. These four substrates 1700A-1700D, (e.g., PCB sheets) can be aligned and fastened together using plastic screws, e.g., without using bonding films. The uppermost layer 1700D is basically an expanded version of the upper layer 900C in the antenna of FIGS. 9A to 9C. The uppermost substrate 1700D includes 8×8 antenna elements, formed by electric dipoles each operably coupled with a parasitic patch arrangement. A conductive surface 1703D, with 64 dumbbell shaped slots, each associated with a respective antenna element, is formed on the lower surface of the substrate layer of the uppermost substrate 1700D. The second-uppermost layer 1700C is a power divider with multiple power divider assemblies. Each of the power divider assembly is essentially a four-way coupler that transfers power between the lower substrates 1700A, 1700B and the uppermost substrate 1700D. Each four-way coupler may have the form as that in FIG. 13, and are coupled with 4 different antenna elements. A conductive surface 1703C, with 16 dumbbell shaped slots, each associated with a power divider assembly, is formed on the lower surface of the substrate layer of the second-uppermost substrate 1703C. The lower substrate 1700B right below the second-uppermost substrate 1700C is a power divider with multiple power divider assemblies. Each of the power divider assembly is essentially a four-way coupler that transfers power between the lower substrates 1700A, 1700B and the uppermost substrate 1700D. Each four-way coupler may have the form as that in FIG. 13, and are coupled with 4 different power divider assemblies in the second-uppermost layer 1700C. The lower-most substrate 1700A is a coupling portion that includes a substrate integrated waveguide to waveguide (external) transition, which couples the substrate integrated waveguide to an external waveguide (not shown). The antenna 1700 is a linearly-polarized antenna.

Figure 18B:
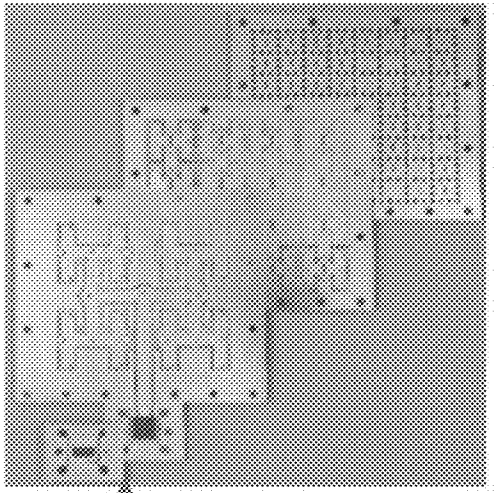
FIG. 18B is a picture showing a top view of the disassembled substrate integrated waveguide fed antenna array of FIG. 18A.
Figure 18A:
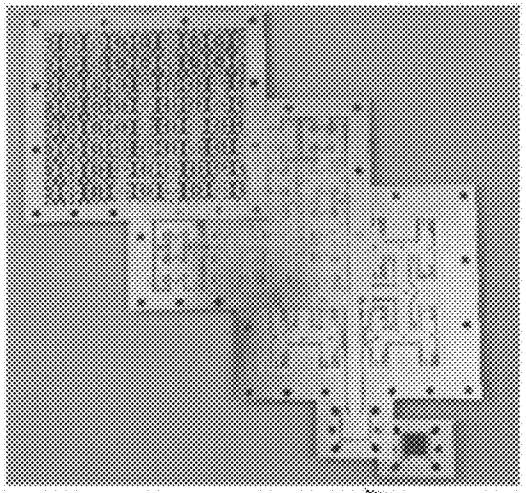
FIG. 18A is a picture showing a bottom view of a disassembled substrate integrated waveguide fed antenna array fabricated based on FIG. 17.

FIGS. 18A and 18B show an antenna fabricated based on the design of FIG. 17. FIG. 18A shows the top views of the four PCB layers (from left to right, upper to lower); FIG. 18B shows the bottom view of the four PCB layers (from left to right, lower to upper). Each of the up three layers has a size of 96×96×0.3 $mm^3$ and the extra substrate stub in the bottom layer is 26×30×0.787 $mm^3$.

The standing wave ratio of the antenna of FIGS. 18A and 18B was measured by an Agilent Network Analyzer E8361A; the radiation patterns of the antenna was measured by an NSI 2000 near-field measurement system. Due to the limitation of the measurement system, the scanning range can only display from −600 to 600. A 4 GHz to 40 GHz standard horn was employed to get the realized gain of the antenna array.

Figure 19:
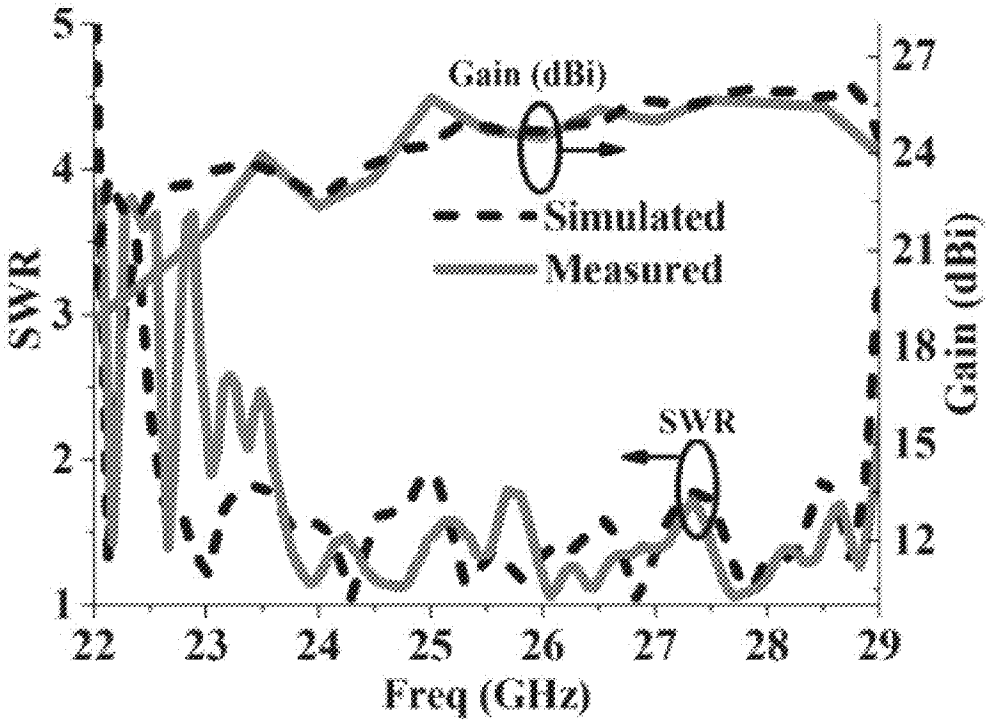
FIG. 19 is a graph showing the simulated and measured standing wave ratio (SWR) and the antenna gain (dBi) of the antenna array of FIGS. 18A and 18B at different frequencies.
Figures 20A, 20B, 20C:
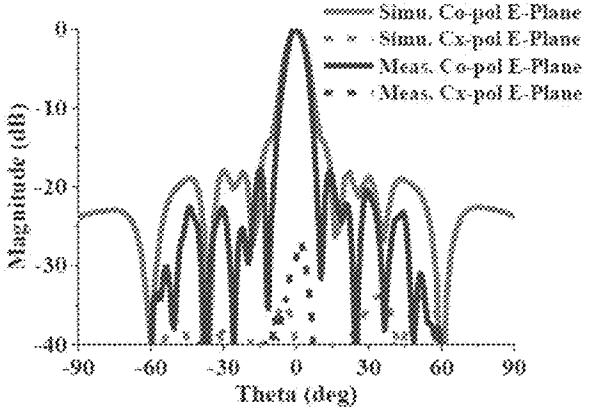
FIG. 20A is a graph showing the simulated and measured E-plane radiation pattern for the antenna array of FIGS. 18A and 18B at 24 GHz.
FIG. 20B is a graph showing the simulated and measured E-plane radiation pattern for the antenna array of FIGS. 18A and 18B at 26 GHz.
FIG. 20C is a graph showing the simulated and measured E-plane radiation pattern for the antenna array of FIGS. 18A and 18B at 28 GHz.
Figure 20E:
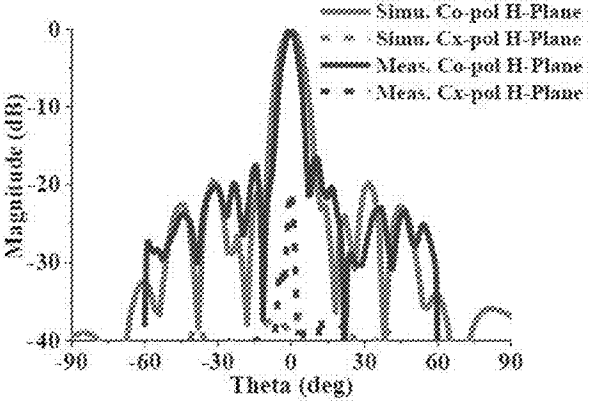
FIG. 20E is a graph showing the simulated and measured H-plane radiation pattern for the antenna array of FIGS. 18A and 18B at 26 GHz.
Figure 20D:
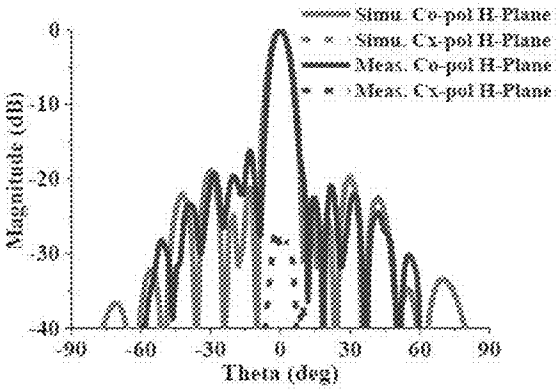
FIG. 20D is a graph showing the simulated and measured H-plane radiation pattern for the antenna array of FIGS. 18A and 18B at 24 GHz.
Figure 20F:
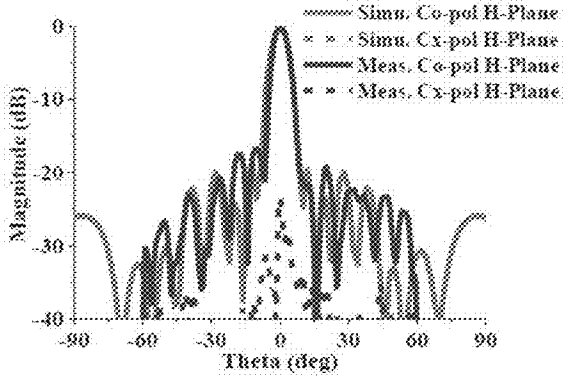
FIG. 20F is a graph showing the simulated and measured H-plane radiation pattern for the antenna array of FIGS. 18A and 18B at 28 GHz.

FIG. 19 shows the simulated and measured results of standing wave ratio and gain are compared in FIG. 19. Reasonably good agreements are seen from 23.5 GHz to 29 GHz. The slight discrepancies between the measured and simulated standing wave ratio may be caused by the air gap between the PCB layers and their misalignments. Further tuning of the power divider may improve the performance of the array at the frequencies below 23.5 GHz. At the frequency points of 24.5 GHz and 25 GHz, the measured gain difference is around 2.5 dB which could be caused by the NSI measured system error, but the overall result across the operating band is acceptable.

Figure 18C:
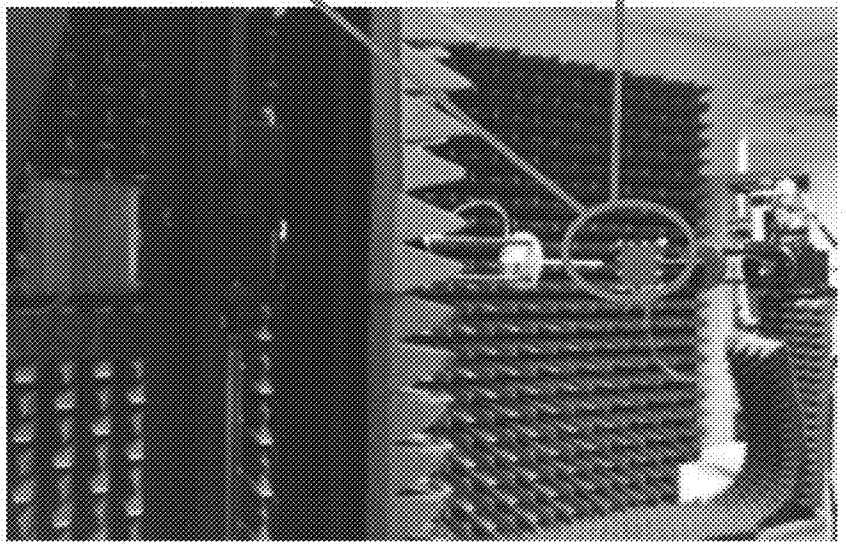
FIG. 18C is a picture showing the testing equipment and environment used for testing the antenna array of FIG. 18A.

FIGS. 20A to 20F show the E- and H-plane radiation patterns of the antenna at 24 GHz, 26 GHz and 28 GHz, respectively. The measured and simulated results in general agree well. The measured E- and H-plane radiation patterns are not perfectly symmetric when compared with the simulated ones. This may be due to one or more of: measurement system, fabrication error, and the asymmetric testing environment as shown in FIG. 18C, where absorbing material were installed only on one side of the measurement system and so may have resulted in asymmetric radiation patterns. The simulated cross-polarization is below −35 dB but the highest measured cross-polarization is −22 dB. This discrepancy may be due to the imperfect measurement setup. Table V shows the performance parameters of the antenna.

TABLE V

| Performance of the antenna | | | | | |
|---|---|---|---|---|---|
| Feed Network | No. of Antenna Elements | Impedance Bandwidth | Max. Gain (dBi) | First Sidelobe (dB) | Efficiency |
| Substrate integrated waveguide | 8 × 8 = 64 | ~20.9% | ~26.2 | ~−17 | ~80% |

The above embodiments have provided, among other things, an antenna with an impedance bandwidth around 36% (standing wave ratio <2). It has stable radiation pattern and low cross-polarization level across the operating band from 22.3 GHz to 32.1 GHz (standing wave ratio <2) with the peak gain up to 9.6 dBi. Based on the 2×2 sub-array, an 8×8 antenna array has been constructed using a non-uniform feeding network to suppress the first sidelobe by around 3.5 dB. The measured result shows that it works from 23.5 GHz to 29 GHz with a peak gain of 26.2 dBi, covering the 5G frequency band as well as the 24.125 GHz frequency band for collision avoidance radar. The antenna element has a single electric dipole. Parasitic patches operably coupled with the dipole facilitate bandwidth broadening and allow the antenna to be made relatively thin without sacrificing the operating bandwidth and simultaneously reducing the cross-polarization level. In some embodiments the wide bandwidth and high gain are achieved by the dipole-patch radiating in tandem. Some embodiments of the antenna have a low profile property, which brings a lower cross-polarization.

Figure 21:
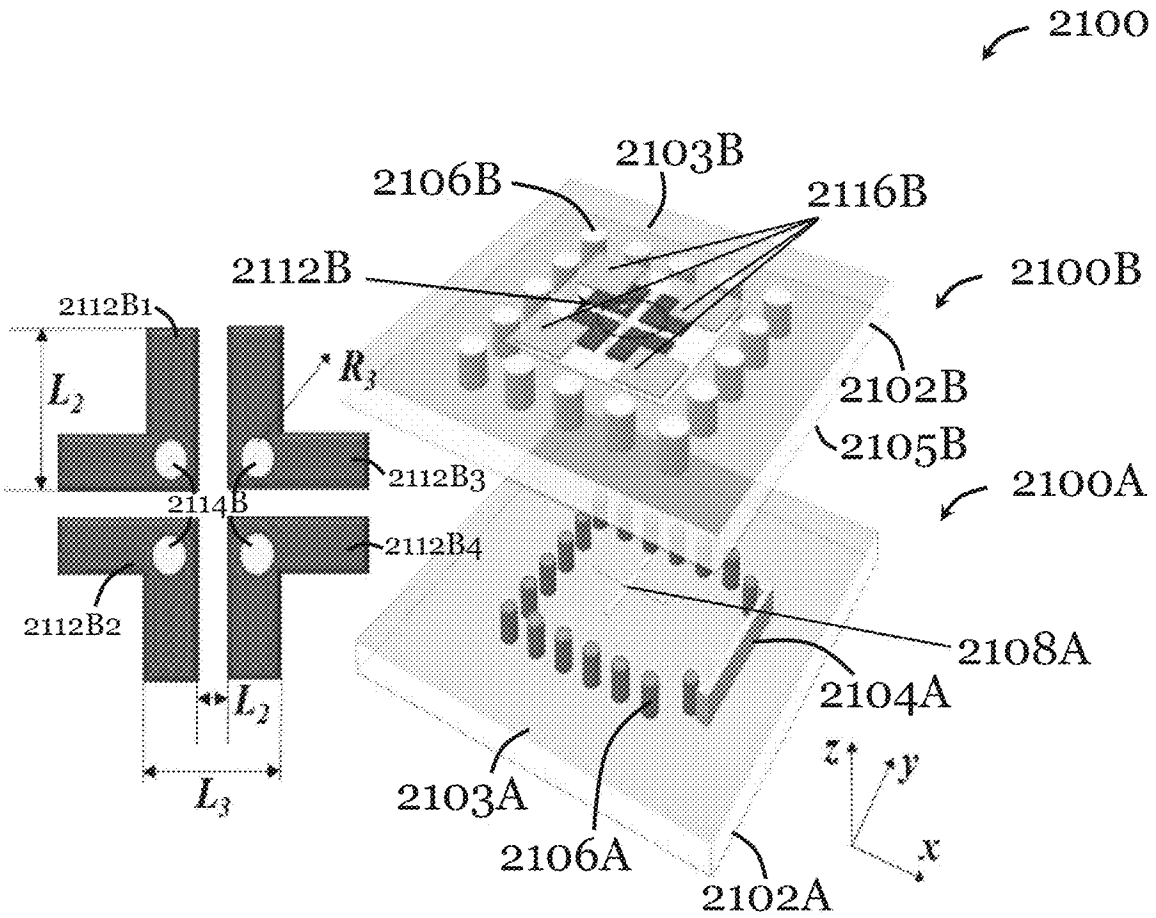
FIG. 21 is an exploded schematic view of a substrate integrated waveguide fed antenna in one embodiment of the invention.

FIG. 21 shows a substrate integrated waveguide fed antenna 2100 in one embodiment of the invention. The antenna 2100 in this embodiment is a dual-polarized antenna. Compared with the embodiments of linearly-polarized antennas, the embodiments of dual-polarized antennas, such as the antenna 2100 in this embodiment, can provide polarization diversity and increased the channel capacity.

The antenna 2100 includes two substrates, an upper substrate 2100B and a lower substrate 2100A. The lower substrate 2100A is essentially a substrate integrated waveguide, which provides a feed structure (not completely shown). The lower substrate 2100A includes a substrate layer 2102A with an upper conductive surface 2103A formed by copper. A feed port 2104A and multiple vias 2106A are arranged in, e.g., extend through, the substrate layer 2102A. The vias 2106A are arranged in a generally U-shaped array in plan view. The upper conductive surface 2103A is a slotted conductive surface having a cross-shaped slot 2108A. The cross-shaped slot 2108A has two slot portions (one extending along the x-direction, another extending along the y-direction) arranged generally perpendicular to each other. In this example, the two slot portions have the same length and width. The cross-shaped slot 2108A is arranged to be aligned and operably coupled with another cross-shaped slot (not shown) formed on the lower conductive surface of the upper substrate 2100B. In this example, the two cross-shaped slots have the same or similar form (two slot portions arranged generally perpendicular to each other) and/or sizes.

The upper substrate 2100B includes a substrate layer 2102B with an upper conductive surface 2103B formed by copper and a lower conductive surface 2105B formed by copper. As mentioned, the lower conductive surface 2105B formed by copper is a slotted conductive surface with a cross-shaped slot 2108B aligned and operably coupled with another cross-shaped slot 2108A formed on the upper conductive surface 2103A of the lower substrate 2100A. The cross-shaped slots 2108A, 2108B are arranged to avoid introducing resonances outside the operating frequency band, preventing gain drop, as well as to facilitate energy coupling between the two substrates 2100A, 2100B to improve impedance matching. The substrate layer 2102B includes multiple vias 2106B arranged in a generally rectangular (e.g., square) shaped array in plan view. The upper conductive surface 2103B includes a loop portion that defines a substrate integrated waveguide cavity. An electric dipole arrangement 2112B and a parasitic patch arrangement 2116B operably coupled with the electric dipole arrangement 2112B are arranged in the cavity. The electric dipole arrangement 2112B is formed by multiple (in this example, four) conductive elements 2112B1-2112B4, in the form of L-shaped conductive patches that are spaced apart from each other. Each of the conductive elements 2112B1-2112B4 includes two leg portions arranged at about 90 degrees to each other. One of the leg portions of each of the conductive elements 2112B1-2112B4 are arranged parallel to each other (more specifically, two leg portions are arranged generally collinearly with each other along an axis along x-direction, and another two leg portions are arranged generally collinearly with each other along another axis parallel to the axis along x-direction); another one of the leg portions of each of the conductive elements 2112B1-2112B4 are arranged parallel to each other (more specifically, two leg portions are arranged generally collinearly with each other along an axis along y-direction, and another two leg portions are arranged generally collinearly with each other along another axis parallel to the axis along y-direction). The generally L-shaped conductive elements 2112B1-2112B4 each have a corner portion between the two leg portions. In plan view, the conductive elements are arranged at or near the corner portions of the generally L-shaped conductive elements 2112B1-2112B4. The corner portions of the generally L-shaped conductive elements 2112B1-2112B4 may be arranged adjacent each other (e.g., in facing relationship). The conductive elements 2112B1-2112B4 are arranged to space apart from each other in such a way that a cross-shaped slot is defined between them. Conductive pins 2114B, e.g., vias or posts, each associated with a respective conductive element 2112B1-2112B4, extends generally perpendicular to the plane and to the slotted conductive surface. In plan view, each respective conductive element 2114B is arranged at or near the corner portion of a respective generally L-shaped conductive elements. The parasitic patch arrangement includes four parasitic patches 2116B, arranged in two pairs, all spaced apart and arranged in the cavity. The patches 2116B are arranged such that each conductive element 2112B1-2112B4 is partly sandwiched between two respective parasitic patches 2116B. The upper conductive surface 2103B, the electric conductive elements 2112B, and the parasitic patch arrangement 2116B may be arranged in the same layer, e.g., formed by etching.

In this embodiment, both substrate layers 2102A, 2102B have a relative dielectric permittivity $\varepsilon_r$ of 2.2, a loss tangent $\delta$ of 0.0009, and a thickness $H_1$, $H_2$ of 0.787 mm. The conductive copper surfaces 2103A, 2103B, 2105B each have a thickness t of 9 μm.

In this embodiment, only one feed port (or waveguide excitation port) of the feed structure is illustrated and the simulation results are only associated with the one illustrated feed port. The skilled person would appreciate that the feed structure of the antenna 2100 would have at least one other feed port (or waveguide excitation port) arranged in, e.g., extend through, the substrate layer 2102A. That other feed port may be arranged to extend in the direction generally perpendicular to the illustrated feed port. In one example, it is envisaged that the two feed ports may be combined as one.

Figure 22:
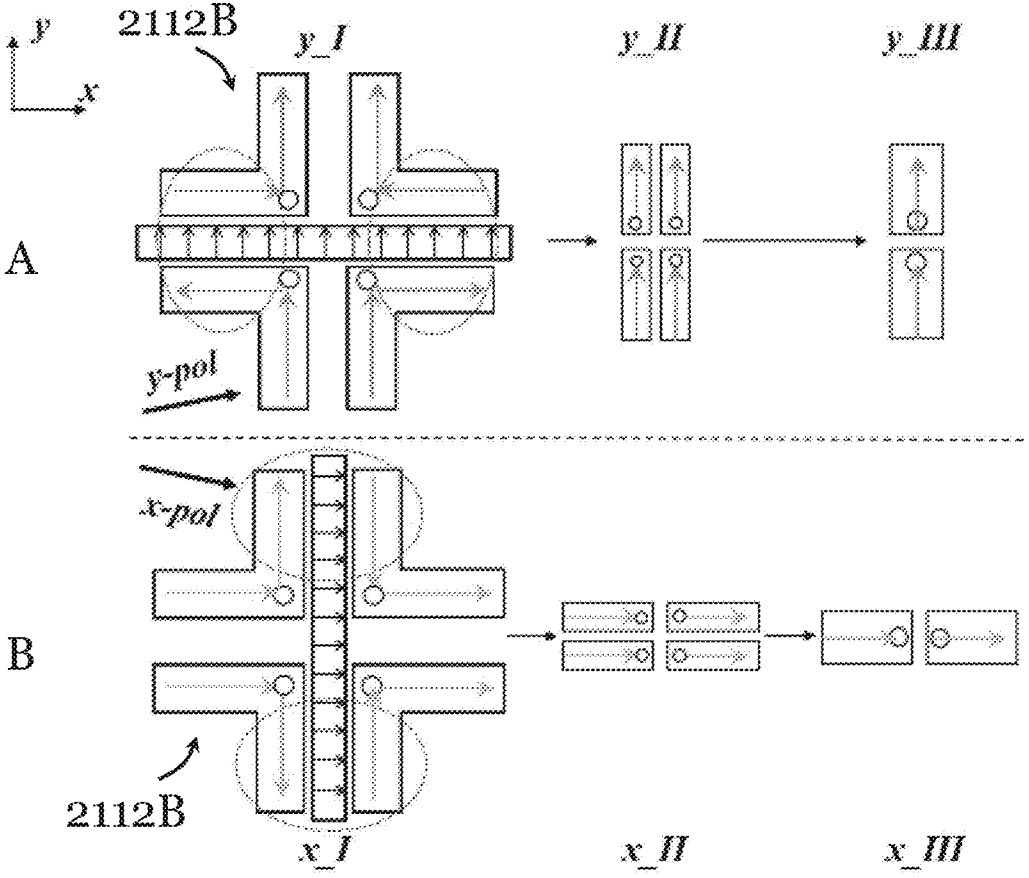
FIG. 22 is a schematic diagram illustrating the operation principle of the substrate integrated waveguide fed antenna of FIG. 21.

FIG. 22 illustrates the working principle of the antenna 2100 of FIG. 21. In FIG. 22, part A correspond to y-polarization excitation and part B corresponds to x-polarization excitation. Take the y-polarization excitation in part A as an example. When the cross-shaped slot's portion along the x-direction is excited (via the feed structure), the electric field is generally uniform on the slot along the y-direction. Thus, the current on the split conductive elements 2112B1-2112B4 flows as illustrated by the arrow in y_I. As a result, the current at the parallel leg portions of the conductive elements 2112B1-2112B4 in y_I (illustrated by the dashed circles) will generally cancel each other. This forms the equivalent current y_II, or more simply, y_III, which generally corresponds to a driven dipole along the y-direction. Take the x-polarization excitation in part B as an example. When the cross-shaped slot's portion along the y-direction is excited (via the feed structure), the electric field is generally uniform on the slot along the y-direction. Thus, the current on the split dipole elements 2112B1-2112B4 flows as illustrated by the arrow in x_I. As a result, the current at the parallel leg portions of the dipole elements 2112B1-2112B4 in x_I (illustrated by the dashed circles) will generally cancel each other. This forms the equivalent current y_II, or more simply, y_III, which generally corresponds to a driven dipole along the x-direction. In other words, in this embodiment, the four generally L-shaped conductive elements could be considered equivalent to a dipole along one polarization and another dipole along another polarization.

Figure 23:
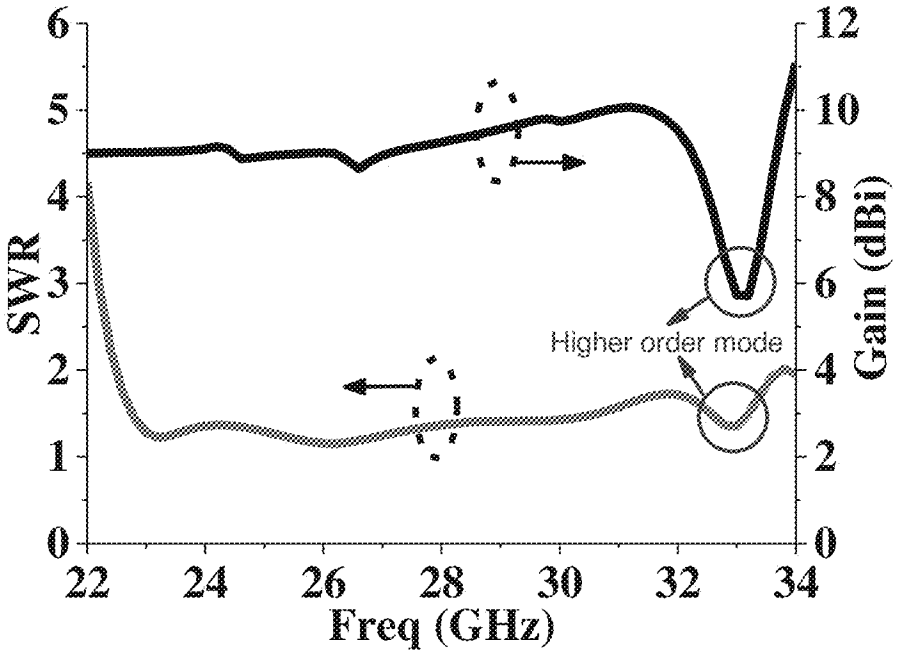
FIG. 23 is a graph showing the simulated and measured standing wave ratio (SWR) and the antenna gain (dBi) of the antenna of FIG. 21 in one polarization.
Figures 24A, 24B:
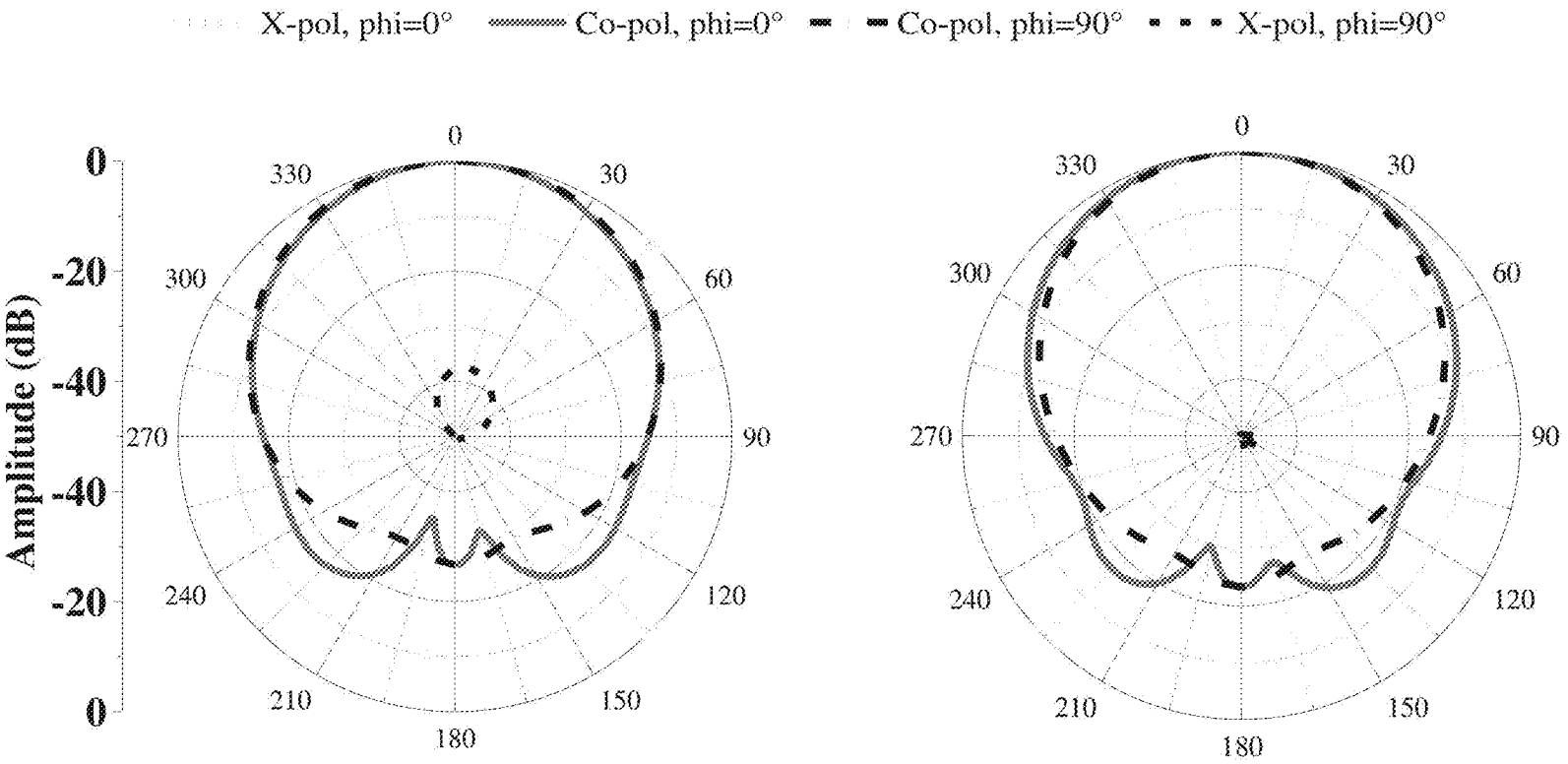
FIG. 24A is a plot showing a simulated radiation pattern of the antenna of FIG. 21 at 23 GHz (for co-polarization at 0° and 90° and cross-polarization at 0° and 90°)
FIG. 24B is a plot showing a simulated radiation pattern of the antenna of FIG. 21 at 27 GHz (for co-polarization at 0° and 90° and cross-polarization at 0° and 90°)
Figure 24D:
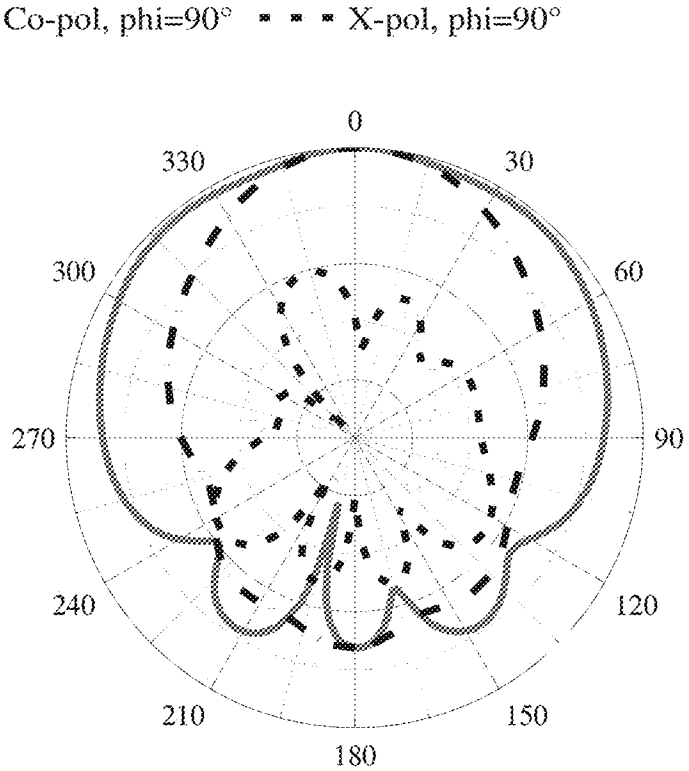
FIG. 24D is a plot showing a simulated radiation pattern of the antenna of FIG. 21 at 33 GHz (for co-polarization at 0° and 90° and cross-polarization at 0° and 90°)
Figure 24C:
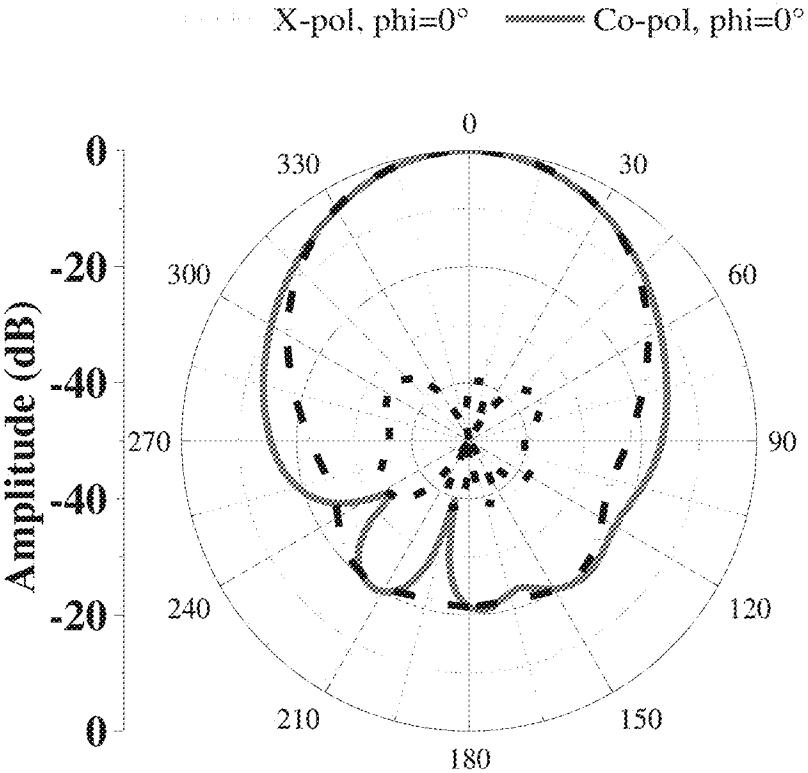
FIG. 24C is a plot showing a simulated radiation pattern of the antenna of FIG. 21 at 31 GHz (for co-polarization at 0° and 90° and cross-polarization at 0° and 90°)

FIG. 23 shows the simulated and measured standing wave ratio (SWR) and the antenna gain (dBi) of the antenna 2100 of FIG. 21 in one polarization. FIGS. 24A-24D show simulated radiation pattern of the antenna 2100 of FIG. 21 at 23 GHz, 27 GHz, 31 GHz, and 33 GHz respectively (for co-polarization at 0° and 90° and cross-polarization at 0° and 90°). As seen from FIG. 23, the SWR (standing wave ratio) is less than 2 in the range from 22.11 to 33.6 GHz (BW=41.25%), whereas the average gain reaches 8.5 dBi, and at 31.5 GHz, the gain is 10 dBi. Although at 33 GHz the radiation pattern becomes less symmetrical (due to, e.g., the appearance of the higher-order mode), relatively stable radiation patterns can be observed across the operating frequency band as shown in FIGS. 24A-24D. This design embodiment and its variants are advantageous as they can provides a relatively low cross-polarization level (at 23 GHz, 27 GHz, and 31 GHz, the cross-polarization level is below −35 dB, and even at the higher-order mode 33 GHz, the cross-polarization level is still below −20 dB).

Figure 25:
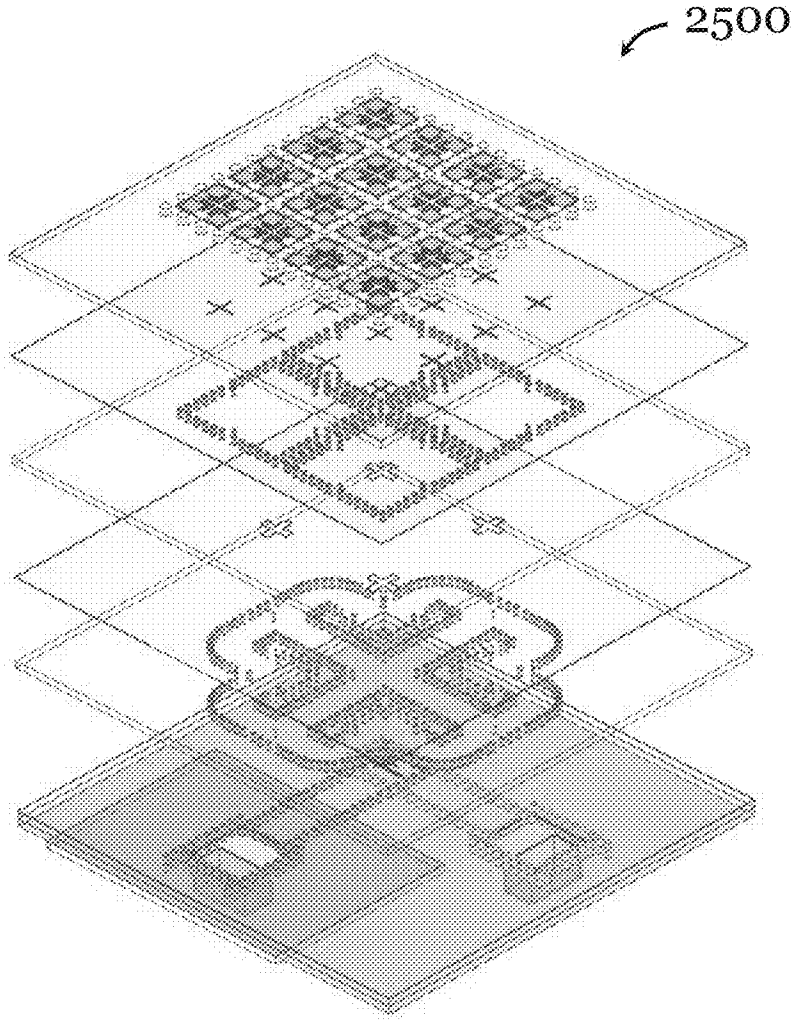
FIG. 25 is a schematic diagram illustrating a substrate integrated waveguide fed antenna array in one embodiment of the invention.

FIG. 25 shows a substrate integrated waveguide fed antenna 2500 in one embodiment of the invention, built upon the antenna design in FIGS. 21 and 22. The antenna 2500 has a 4×4 antenna elements array based upon the antenna design in FIGS. 21 and 22. The antenna 2500 is a dual-polarized antenna.

It will be appreciated by persons skilled in the art that numerous variations and/or modifications may be made to the invention as shown in the specific embodiments without departing from the scope of the invention as broadly described or as specified in the claims. The described embodiments of the invention should therefore be considered in all respects as illustrative, not restrictive.

For example, the antenna can have different thicknesses (although thinner is better for applications in which space is limited), the antenna can be comprised of different layers of substrates, etc. Each substrate can include any number of layers, sub-layers, conductive surfaces, depending on applications. Different substrates can have different dimensions or geometries (e.g., thicknesses), formed with different dielectric constants, etc. The conductive surfaces can be formed with metals other than copper. The conductive surfaces can be (but need not be) integrated with any of the substrate. The vias in the substrates can be arranged in a different pattern. The vias can be replaced with like conductive means such as pins, via holes, conductive posts, etc. The antenna can operate in different frequency ranges, not limited to those specifically illustrated in the above embodiments. The antenna can be incorporated into different types of electrical, electronic, communication devices, systems, apparatus, or the like. The electric dipole arrangement can be formed by different number of dipole elements, conductive elements or arms and/or different forms of conductive elements (not necessarily L-shaped) or arms (not necessarily rectangular). The parasitic patches can be arranged formed by different number of patches and/or different forms of patches. It should be noted that the term "electric dipole arrangement" covers various arrangements of conductive and/or dipole elements that can provide electric dipole(s), including but not limited to those specifically described.

The invention claimed is:

1. A substrate integrated waveguide fed antenna, comprising:

an electric dipole arrangement;

a parasitic patch arrangement operably coupled with the electric dipole arrangement;

a feed structure including a substrate integrated waveguide operably coupled with the electric dipole arrangement for exciting the electric dipole arrangement; and a slotted conductive surface with a slot arranged between the electric dipole arrangement and the feed structure for operably coupling the feed structure with the electric dipole arrangement;

wherein the substrate integrated waveguide fed antenna is a dual-polarized antenna.

2. The substrate integrated waveguide fed antenna of claim 1, wherein the electric dipole arrangement comprises a plurality of conductive elements arranged on a plane that is spaced apart from and generally parallel to the slotted conductive surface, and the plurality of conductive elements are spaced apart from each other.

3. The substrate integrated waveguide fed antenna of claim 2, wherein each of the plurality of conductive elements comprises first and second leg portions arranged at an angle to each other.

4. The substrate integrated waveguide fed antenna of claim 3, wherein the angle is generally 90 degrees such that each of the plurality of conductive elements is generally L-shaped.

5. The substrate integrated waveguide fed antenna of claim 3, wherein the first leg portions of the plurality of conductive elements are generally parallel to each other; and the second leg portions of the plurality of conductive elements are generally parallel to each other.

6. The substrate integrated waveguide fed antenna of claim 5, wherein the plurality of conductive elements are arranged to space apart from each other in such a way that a cross-shaped slot is defined between them, and wherein, in plan view, the slot is arranged in the cross-shaped slot.

7. The substrate integrated waveguide fed antenna of claim 2, wherein the plurality of conductive elements includes three or more conductive elements.

8. The substrate integrated waveguide fed antenna of claim 2, wherein the plurality of conductive elements are arranged in a generally symmetric pattern.

9. The substrate integrated waveguide fed antenna of claim 2, wherein the plurality of conductive elements are spaced apart generally equally and/or have generally the same size and shape.

10. The substrate integrated waveguide fed antenna of claim 2, further comprising a plurality of further conductive elements each associated with a respective conductive element; wherein each of the plurality of further conductive elements extend generally perpendicular to the plane and to the slotted conductive surface.

11. The substrate integrated waveguide fed antenna of claim 10, wherein the plurality of conductive elements are generally L-shaped conductive elements each having a corner portion, and wherein in plan view the further conductive elements are arranged at or near the corner portions of the generally L-shaped conductive elements.

12. The substrate integrated waveguide fed antenna of claim 2, wherein the parasitic patch arrangement comprises a plurality of conductive patches arranged on the plane.

13. The substrate integrated waveguide fed antenna of claim 12, wherein the plurality of conductive patches are arranged around the electric dipole arrangement.

14. The substrate integrated waveguide fed antenna of claim 13, wherein the plurality of conductive patches comprises four or more conductive patches that are spaced apart from each other.

15. The substrate integrated waveguide fed antenna of claim 14, wherein the conductive patches are arranged such that each conductive element is at least partly disposed between two respective conductive patches.

16. The substrate integrated waveguide fed antenna of claim 1, wherein the slot is a cross-shaped slot having first and second slot portions arranged generally perpendicular to each other.

17. The substrate integrated waveguide fed antenna of claim 1, further comprising a substrate, and wherein the electric dipole arrangement and the parasitic patch arrangement are arranged on an outer surface of the substrate.

18. The substrate integrated waveguide fed antenna of claim 17, wherein the substrate integrated waveguide fed antenna further comprises a conductive surface arranged on the outer surface of the substrate, the conductive surface generally surrounds the electric dipole arrangement and the parasitic patch arrangement.

19. The substrate integrated waveguide fed antenna of claim 18, wherein the substrate is a first substrate layer, and the substrate integrated waveguide comprises a second substrate layer, a plurality of via holes formed in the second substrate layer, and a conductive surface on the second substrate layer; and wherein the slotted conductive surface is disposed between the first substrate layer and the second substrate layer.

20. The substrate integrated waveguide fed antenna of claim 19, wherein the conductive surface on the second substrate layer comprises a slot that is generally aligned with the slot of the slotted conductive surface.

21. A substrate integrated waveguide fed antenna array comprising:

a plurality of electric dipole arrangements arranged in an array;

a plurality of parasitic patch arrangements each operably coupled with a respective one of the electric dipole arrangement;

a feed structure including a substrate integrated waveguide operably coupled with the electric dipole arrangements for exciting the electric dipole arrangements; and a slotted conductive surface with a plurality of slots each associated with a respective electric dipole arrangement, each slot being arranged between the respective electric dipole arrangement and the feed structure for operably coupling the feed structure with the respective electric dipole arrangement;

wherein the substrate integrated waveguide fed antenna array is a dual-polarized antenna array.

22. The substrate integrated waveguide fed antenna array of claim 21, wherein each of the plurality of electric dipole arrangements comprises a plurality of conductive elements arranged on a plane that is spaced apart from and generally parallel to the slotted conductive surface; and, for each respective one of the electric dipole arrangement, the plurality of conductive elements are spaced apart from each other.

23. The substrate integrated waveguide fed antenna of claim 22, wherein each of the plurality of conductive elements comprises first and second leg portions arranged at an angle to each other.

24. The substrate integrated waveguide fed antenna of claim 23, wherein the angle is generally 90 degrees such that each of the plurality of conductive elements is generally L-shaped.

25. The substrate integrated waveguide fed antenna of claim 24, wherein the plurality of conductive elements are arranged to space apart from each other in such a way that a cross-shaped slot is defined between them, and wherein, in plan view, the slot is arranged in the cross-shaped slot.

26. The substrate integrated waveguide fed antenna of claim 22, wherein the plurality of conductive elements includes three or more conductive elements.

27. The substrate integrated waveguide fed antenna array of claim 22, further comprising, for each respective one of the electric dipole arrangement, a plurality of further conductive elements each associated with a respective conductive element; and wherein each of the plurality of further conductive elements extend generally perpendicular to the plane and to the slotted conductive surface.

28. The substrate integrated waveguide fed antenna array of claim 27, wherein the plurality of conductive elements are generally L-shaped conductive elements each having a corner portion, and wherein in plan view the further conductive elements are arranged at or near the corner portions of the generally L-shaped conductive elements.

29. The substrate integrated waveguide fed antenna array of claim 22, wherein the parasitic patch arrangement comprises a plurality of conductive patch assemblies arranged on the plane, and wherein each of the respective conductive patch assembly is arranged around a respective one of the electric dipole arrangement.

30. The substrate integrated waveguide fed antenna array of claim 29, wherein each of the respective conductive patch assembly comprises four or more conductive patches that are spaced apart from each other.

31. The substrate integrated waveguide fed antenna array of claim 29, wherein the conductive patches are arranged such that each conductive element is at least partly disposed between two respective conductive patches in the respective conductive patch assembly.

32. The substrate integrated waveguide fed antenna array of claim 21, wherein each of the plurality of slots is a cross-shaped slot having first and second slot portions arranged generally perpendicular to each other.

33. A substrate integrated waveguide fed antenna, comprising:

an electric dipole arrangement;

a parasitic patch arrangement operably coupled with the electric dipole arrangement;

a feed structure including a substrate integrated waveguide operably coupled with the electric dipole arrangement for exciting the electric dipole arrangement; and a slotted conductive surface with a slot arranged between the electric dipole arrangement and the feed structure for operably coupling the feed structure with the electric dipole arrangement;

wherein the electric dipole arrangement comprises a plurality of conductive elements arranged on a plane that is spaced apart from and generally parallel to the slotted conductive surface, and the plurality of conductive elements are spaced apart from each other; and wherein each of the plurality of conductive elements comprises first and second leg portions arranged at an angle to each other.

34. The substrate integrated waveguide fed antenna of claim 33, wherein the angle is generally 90 degrees such that each of the plurality of conductive elements is generally L-shaped.

35. The substrate integrated waveguide fed antenna of claim 33, wherein the first leg portions of the plurality of conductive elements are generally parallel to each other; and the second leg portions of the plurality of conductive elements are generally parallel to each other.

36. The substrate integrated waveguide fed antenna of claim 35, wherein the plurality of conductive elements are arranged to space apart from each other in such a way that a cross-shaped slot is defined between them, and wherein, in plan view, the slot is arranged in the cross-shaped slot.

37. A substrate integrated waveguide fed antenna, comprising:

an electric dipole arrangement;

a parasitic patch arrangement operably coupled with the electric dipole arrangement;

a feed structure including a substrate integrated waveguide operably coupled with the electric dipole arrangement for exciting the electric dipole arrangement; and a slotted conductive surface with a slot arranged between the electric dipole arrangement and the feed structure for operably coupling the feed structure with the electric dipole arrangement;

wherein the electric dipole arrangement comprises a plurality of conductive elements arranged on a plane that is spaced apart from and generally parallel to the slotted conductive surface, and the plurality of conductive elements are generally L-shaped conductive elements each having a corner portion and are spaced apart from each other;

wherein the substrate integrated waveguide fed antenna further comprises a plurality of further conductive elements each associated with a respective conductive element; and wherein each of the plurality of further conductive elements extend generally perpendicular to the plane and to the slotted conductive surface, and in plan view, the further conductive elements are arranged at or near the corner portions of the generally L-shaped conductive elements.

38. A substrate integrated waveguide fed antenna, comprising:

an electric dipole arrangement;

a parasitic patch arrangement operably coupled with the electric dipole arrangement;

a feed structure including a substrate integrated waveguide operably coupled with the electric dipole arrangement for exciting the electric dipole arrangement; and a slotted conductive surface with a slot arranged between the electric dipole arrangement and the feed structure for operably coupling the feed structure with the electric dipole arrangement;

wherein the slot is a cross-shaped slot having first and second slot portions arranged generally perpendicular to each other.

39. A substrate integrated waveguide fed antenna array comprising:

a plurality of electric dipole arrangements arranged in an array;

a plurality of parasitic patch arrangements each operably coupled with a respective one of the electric dipole arrangement;

a feed structure including a substrate integrated waveguide operably coupled with the electric dipole arrangements for exciting the electric dipole arrangements; and a slotted conductive surface with a plurality of slots each associated with a respective electric dipole arrangement, each slot being arranged between the respective electric dipole arrangement and the feed structure for operably coupling the feed structure with the respective electric dipole arrangement;

wherein each of the plurality of electric dipole arrangements comprises a plurality of conductive elements arranged on a plane that is spaced apart from and generally parallel to the slotted conductive surface, and, for each respective one of the electric dipole arrangement, the plurality of conductive elements are spaced apart from each other;

wherein each of the plurality of conductive elements comprises first and second leg portions arranged at an angle to each other.

40. The substrate integrated waveguide fed antenna of claim 39, wherein the angle is generally 90 degrees such that each of the plurality of conductive elements is generally L-shaped.

41. The substrate integrated waveguide fed antenna of claim 40, wherein the plurality of conductive elements are arranged to space apart from each other in such a way that a cross-shaped slot is defined between them, and wherein, in plan view, the slot is arranged in the cross-shaped slot.

42. A substrate integrated waveguide fed antenna array comprising:

a plurality of electric dipole arrangements arranged in an array;

a plurality of parasitic patch arrangements each operably coupled with a respective one of the electric dipole arrangement;

a feed structure including a substrate integrated waveguide operably coupled with the electric dipole arrangements for exciting the electric dipole arrangements; and a slotted conductive surface with a plurality of slots each associated with a respective electric dipole arrangement, each slot being arranged between the respective electric dipole arrangement and the feed structure for operably coupling the feed structure with the respective electric dipole arrangement;

wherein each of the electric dipole arrangement comprises a plurality of conductive elements arranged on a plane that is spaced apart from and generally parallel to the slotted conductive surface; and, for each respective one of the electric dipole arrangement, the plurality of conductive elements are generally L-shaped conductive elements each having a corner portion and are spaced apart from each other;

wherein the substrate integrated waveguide fed antenna array further comprises, for each respective one of the electric dipole arrangement, a plurality of further conductive elements each associated with a respective conductive element;

wherein each of the further conductive elements extend generally perpendicular to the plane and to the slotted conductive surface, and in plan view, the further conductive elements are arranged at or near the corner portions of the generally L-shaped conductive elements.

43. A substrate integrated waveguide fed antenna array comprising:

a plurality of electric dipole arrangements arranged in an array;

a plurality of parasitic patch arrangements each operably coupled with a respective one of the electric dipole arrangement;

a feed structure including a substrate integrated waveguide operably coupled with the electric dipole arrangements for exciting the electric dipole arrangements; and a slotted conductive surface with a plurality of slots each associated with a respective electric dipole arrangement, each slot being arranged between the respective electric dipole arrangement and the feed structure for operably coupling the feed structure with the respective electric dipole arrangement;

wherein each of the plurality of slots is a cross-shaped slot having first and second slot portions arranged generally perpendicular to each other.

* * * * *